US007293492B2

(12) United States Patent
Brunn

(10) Patent No.: US 7,293,492 B2
(45) Date of Patent: Nov. 13, 2007

(54) MULTIPLE PROJECTILE LAUNCHER

(76) Inventor: Michael Brunn, 308 Littleworth La., Sea Cliff, NY (US) 11579

( * ) Notice: Subject to any disclaimer, the term of this patent is extended or adjusted under 35 U.S.C. 154(b) by 0 days.

(21) Appl. No.: 10/960,661

(22) Filed: Oct. 7, 2004

(65) Prior Publication Data

US 2006/0027082 A1 Feb. 9, 2006

Related U.S. Application Data

(60) Provisional application No. 60/509,151, filed on Oct. 7, 2003.

(51) Int. Cl.
*F41F 3/04* (2006.01)

(52) U.S. Cl. ..... 89/1.807; 89/1.815; 89/1.816

(58) Field of Classification Search ..... 89/1.815, 89/1.816, 1.8, 1.807
See application file for complete search history.

(56) References Cited

U.S. PATENT DOCUMENTS 3,106,132 A * 10/1963 Biermann et al. ..... 89/1.815
3,180,224 A * 4/1965 Linke ..... 89/1.801
3,742,813 A * 7/1973 Kongelbeck ..... 89/1.807
4,004,487 A * 1/1977 Eichweber ..... 89/1.815
4,063,485 A * 12/1977 Carter et al. ..... 89/1.816
5,117,731 A * 6/1992 Mendenhall ..... 89/1.816
5,269,214 A * 12/1993 Badura et al. ..... 89/1.41
5,413,024 A * 5/1995 Plummer ..... 89/1.816
6,125,734 A * 10/2000 Yagla ..... 89/1.816
6,584,881 B1 * 7/2003 Boudreau et al. ..... 89/1.804
6,691,600 B2 * 2/2004 Boudreau et al. ..... 89/1.815
2002/0088367 A1 7/2002 MacAleese et al.
2002/0144446 A1 10/2002 Lindahl
2003/0000122 A1 1/2003 Vanek et al.
2003/0089220 A1 * 5/2003 Boudreau et al. ..... 89/1.815
2003/0110973 A1 6/2003 Mutascio et al.
2003/0116048 A1 6/2003 Bossarte et al.
2003/0145840 A1 8/2003 Sanford et al.
2003/0159572 A1 8/2003 Downs, Jr.

* cited by examiner

*Primary Examiner*—Bret Hayes
(74) *Attorney, Agent, or Firm*—Cohen Pontani Lieberman & Pavane LLP

(57) ABSTRACT

In a multiple projectile launcher system, cartridges are securely held within a cassette that can be loaded into a locking and priming mechanism in a base of a multiple projectile launcher. Once the cassette is loaded into the locking and priming mechanism, the cartridges in the cassette may be primed by moving the locking and priming mechanism (which is holding the cassette) such that electric igniter contacts in the launcher base are in contact with electric igniters at the priming end of each cartridge. Once the cassette is locked (thereby priming the plural cartridges held in the cassette), the cartridges may be fired singly, severally, and/or all at the same time, using an electrically initiated fire control system. The multiple projectile launcher is particularly effective in crowd and/or riot control, where the payload of the cartridges comprise non-lethal and/or less-lethal munitions, such as tear gas grenades, sting-ball grenades, flash-bang rounds, bean bags, etc.

50 Claims, 16 Drawing Sheets

MULTIPLE PROJECTILE LAUNCHER

RELATED APPLICATIONS

This application claims priority under 35 U.S.C. §119(e) from U.S. Provisional Patent Application Ser. No. 60/509,151 which was filed on Oct. 7, 2003, and which is hereby incorporated by reference in its entirety.

BACKGROUND OF THE INVENTION

1. Field of the Invention

The present invention relates generally to a launcher for projectiles, and particularly to a launcher of multiple less/non-lethal projectiles.

2. Description of the Related Art

In recent years, national governments, international institutions, and law enforcement agencies have put a greater emphasis on the use of less-lethal and/or non-lethal weaponry (hereinafter the term 'less-lethal' will encompass both less-lethal and non-lethal). The purpose of such weapons is not to kill, but to incapacitate, or, in some cases, to deter the subject from further approach. Much of the armament within the less-lethal arsenal is for the purposes of riot control and/or crowd dispersal, i.e., situations that typically involve a small group of security personnel attempting to control and/or disperse a large group of combative antagonists who, even if they are not armed with conventional firearms, can still injure and/or kill the security personnel with objects at hand.

The typical weapons deployed to disperse a crowd, such as a tear gas canister either thrown by hand or launched by a launcher, are problematic. For instance, a tear gas canister, after landing among a group of antagonists, may be picked up by an antagonist and then thrown back at the security personnel. Furthermore, if it is desired to saturate a certain area with tear gas, a group of security personnel must synchronize their aiming and firing in order to effectively target the certain area. Thus, even though there may be many different phenomena which require different security personnel's attention in a riot control situation, a group of them must be focused on this one task.

Therefore, there is a need for a launcher of less-lethal munitions, such as tear gas, which makes it difficult for the antagonists to throw the munitions back at the security personnel, allows the security personnel a greater degree of protection from the antagonists, and provides the security personnel greater freedom of movement and action when responding to the antagonists.

SUMMARY OF THE INVENTION

A multiple projectile launcher according to the present invention is a system in which a plurality of cartridges are held within a cassette that can be inserted into a locking and priming mechanism in a base of the multiple projectile launcher. Once the cassette is loaded into the locking and priming mechanism, the cartridges in the cassette may be primed by moving the locking and priming mechanism (which is holding the cassette) such that electric igniter contacts in the launcher base are in contact with electric igniters in each cartridge. Once the cassette is locked (thereby priming the plural cartridges held in the cassette), the plural cartridges may be fired singly, severally, and/or all at the same time.

Each cartridge comprises a cartridge case containing propellant and a payload, where one end of the cartridge case has an electrode for connecting the electric igniter contact of the launcher base to the electric igniter in the cartridge. In the presently preferred embodiment, the payload of the cartridges comprise non-lethal and/or less-lethal munitions, such as tear gas grenades, sting-ball grenades, flash-bang rounds, bean bags, etc. Furthermore, in the presently preferred embodiment, each cartridge is inserted into a slot in the cassette in order to form a friction seal with the inner tapered surface of the slot. However, in other embodiments, the cartridges may, for example, be permanently affixed to the cassette, or use a notch-and-detent system to hold the cartridges in the cassette. In addition, the cartridges may contain, for example, lethal payloads and/or pyrotechnics.

There are many benefits and advantages of the multiple projectile launcher according to the present invention, including, but not limited to: (a) the ability to saturate an area, or a multitude of areas, with munitions, (b) the flexibility, provided by electronic fire control, to fire one, several, or all cartridges according to a particular timing pattern, to create a certain effect, (c) the wide variety of possible placements and/or mountings of the launcher (such as on a vehicle, on a turret, on its own movable carriage, or statically mounted to a building), (d) the launcher does not require many people to operate and can, in fact, be operated by one person, and (e) because the cassettes can be preloaded with cartridges, and the loading, locking, and priming functions can be performed quickly and efficiently, a small number of security personnel can inundate a crowd of a much greater number of people with munitions in a short period of time with little effort compared to performing the same task with prior art munition launching means, such as individually carried and fired grenade launchers, shotguns, or rifles.

In one aspect, a multiple projectile launcher according to the present invention comprises a modular unit which may be connected with other multiple projectile launching units to effect a desired spread of fire, a desired number of launchable munitions, a desired combination of elevations, or any desired configuration. Each of these modular units would have one bank of cartridges, i.e., one set of contact pads for one set of cartridges held in one cassette (which, in turn, is loaded into one cassette holder appropriately positioned above the contact pads in the launcher base); however, each unit would also have means to securely attach to, and detach from, other units. Moreover, the modular system would comprise other types of units, such as a wedge unit. A wedge unit would be placed between two modular launching units so that one launching unit would have a different elevation than another (or different azimuth, depending on the relative orientation of the configuration to the surrounding environment). In one implementation of this embodiment, fire control would be "plug-n-play", i.e., the set of electric igniter contacts in a launching modular unit would be able to plug into a fire control system as it is added to the configuration.

For a better understanding of the invention, its operating advantages, and specific objects attained by its use, reference should be had to the drawings and descriptive matter in which there is illustrated and described a presently preferred embodiment of the present invention. It is to be understood, however, that the various features of novelty which characterize the invention are pointed out with particularity in the claims annexed to and forming a part of the disclosure. Furthermore, the drawings are designed solely for purposes of illustration and not as a definition of the limits of the invention, for which reference should also be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENT

This detailed description of a multiple projectile launcher according to the presently preferred embodiment is broken into multiple sections, as indicated in the table of contents below. In the first section, the presently preferred embodiment is described in more general terms; in the remaining sections (except the last), the presently preferred embodiment is described in greater detail. The last section describes a modular system based on a multiple projectile launcher as the modular unit.

Figure 1A:
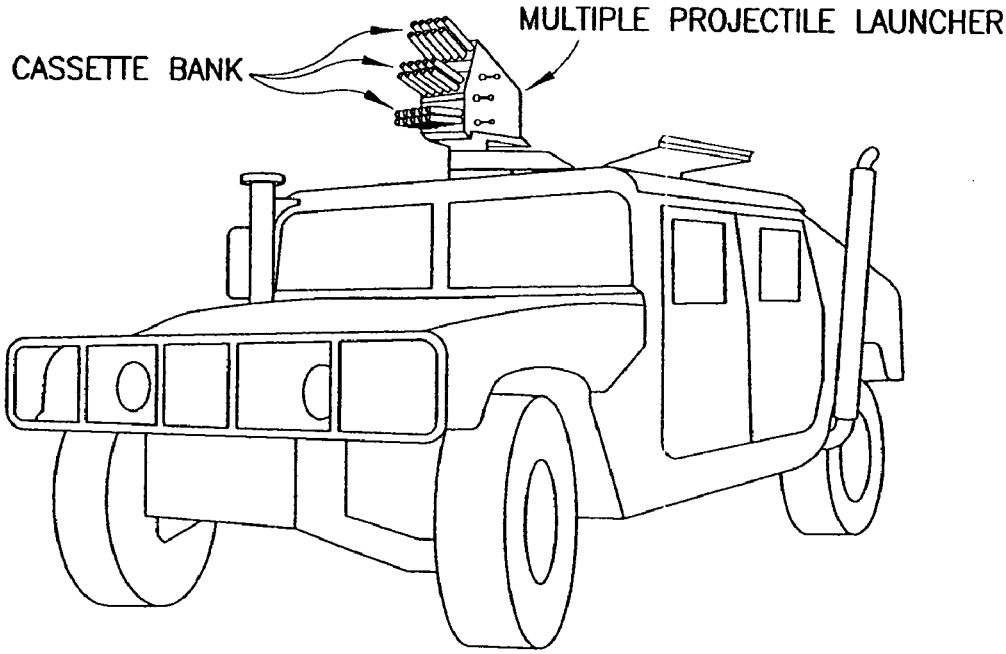
FIG. 1A shows a multiple projectile launcher according to a presently preferred embodiment of the present invention mounted on the roof of a vehicle.
Figure 1B:
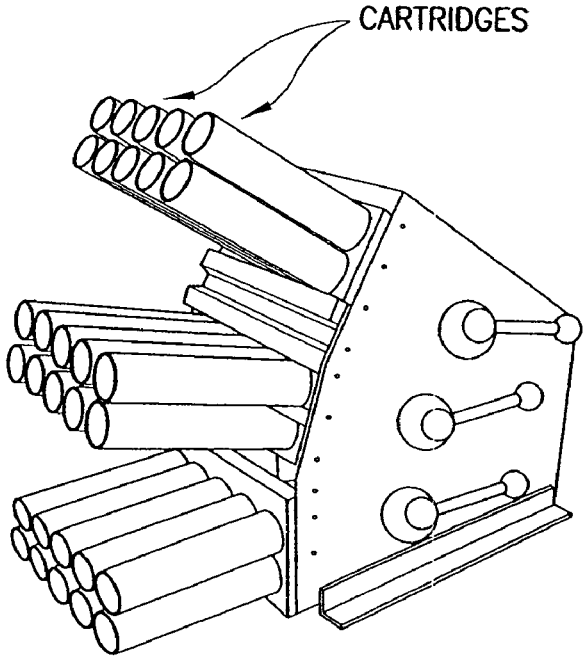
FIG. 1B shows a closer view of an unmounted multiple projectile launcher according to the presently preferred embodiment.
Figure 1C:
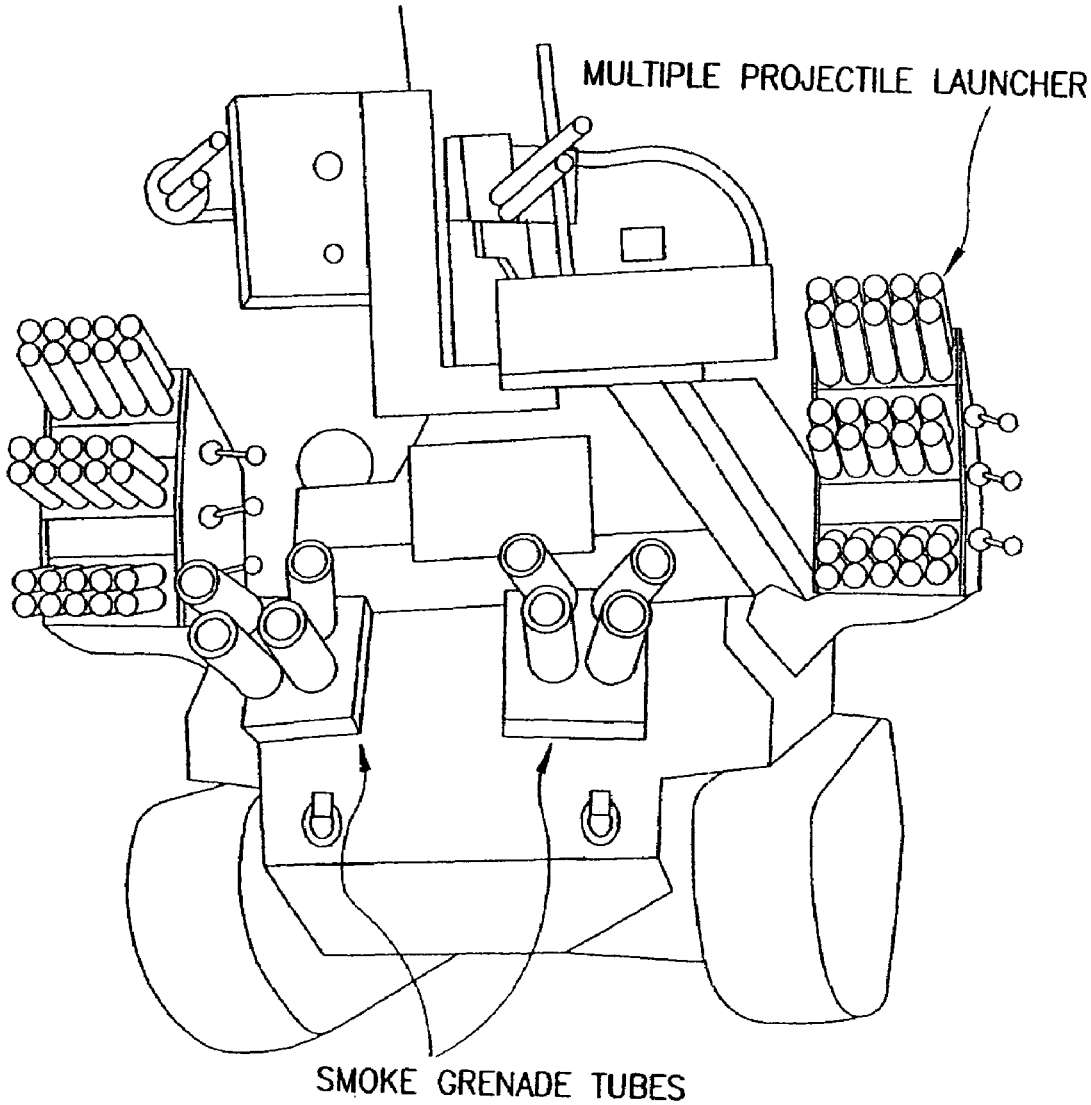
FIG. 1C shows two multiple projectile launchers according to the presently preferred embodiment mounted on each side of a vehicle.

1. General Overview
2. Orientation of the Banks of Cartridges
3. Mounting of the Launcher
4. Fire Control System
5. The Cartridge
6. Loading and Priming the Multiple Projectile Launcher
   (A) Loading Cartridges onto Cassettes
   (B) Loading Cassettes onto the Launcher
   (C) Locking/Priming the Cartridges
7. Modular Launcher System 1. General Overview FIG. 1A shows a military vehicle with a multiple projectile launcher according to the presently preferred embodiment mounted on the roof. A closer view of the multiple projectile launcher according to the preferred embodiment of the present invention is shown in FIG. 1B, where the multiple projectile launcher is shown unmounted and set on the floor. FIG. 1C shows two multiple projectile launchers according to the present invention mounted on either side of another military vehicle. The parts of the multiple projectile launcher according to the presently preferred embodiment are shown in the schematic diagram of FIG. 2.

As can be seen in FIGS. 1A/1B/1C/2, the multiple projectile launcher has three banks of cartridges, each bank set at a different elevation. Each bank consists of ten cartridges (arrayed in two rows of five) held in a cassette which is loaded into a cassette holding mechanism in the launcher base (the cassette holding mechanism also operates as a locking and priming mechanism, which will be described in greater detail below). The cassettes can not be clearly seen in FIGS. 1A/1B/1C/2 because they are locked in place in the launcher base. In the presently preferred embodiment, there are ten cartridges held in a cassette, but other embodiments may have any number of cartridges, in any pattern (e.g., a rectangular array of three rows of four, a diamond-shaped pattern of six, etc.). In the presently preferred embodiment, the cartridges carry a less-lethal payload, such as tear gas grenades and/or bean bags, but other embodiments may carry any sort of projectile, rocket, or pyrotechnic device as a payload.

In the presently preferred embodiment, the cartridges are loaded into the cassette before the cassette is loaded into the launcher base. The cartridges are loaded into the cassette by inserting each one into a slot in the cassette, where the slot has a tapered inner surface so that an O-ring at the rear of the cartridge forms a friction seal with the inner surface of the slot, thereby holding the cartridge in place. However, other embodiments may use any other means for securely holding the cartridges in the cassette. For example, another embodiment may use a notch-and-detent or clamping system. It is also contemplated that the cassette may be molded from plastic around the cartridges during manufacture, thereby permanently affixing the cartridges in the cassette. In such an embodiment, the contents of the cartridges (e.g., the propellant, igniter, payload, etc.) could be loaded after this step in order to avoid any danger of ignition. Furthermore, the cassette (and the cartridges affixed therein) could be disposed after use, or possibly recycled by the manufacturer (by reloading the cartridges).

Once the cartridges are secured in the cassette, the cassette holding the cartridges is slid into the cassette holding mechanism on the launcher base from the side of the launcher. After firing, the cassette can be removed in the same manner. Thus, the multiple projectile launcher according to the presently preferred embodiment may be quickly and efficiently loaded and reloaded by one person.

Figure 2:
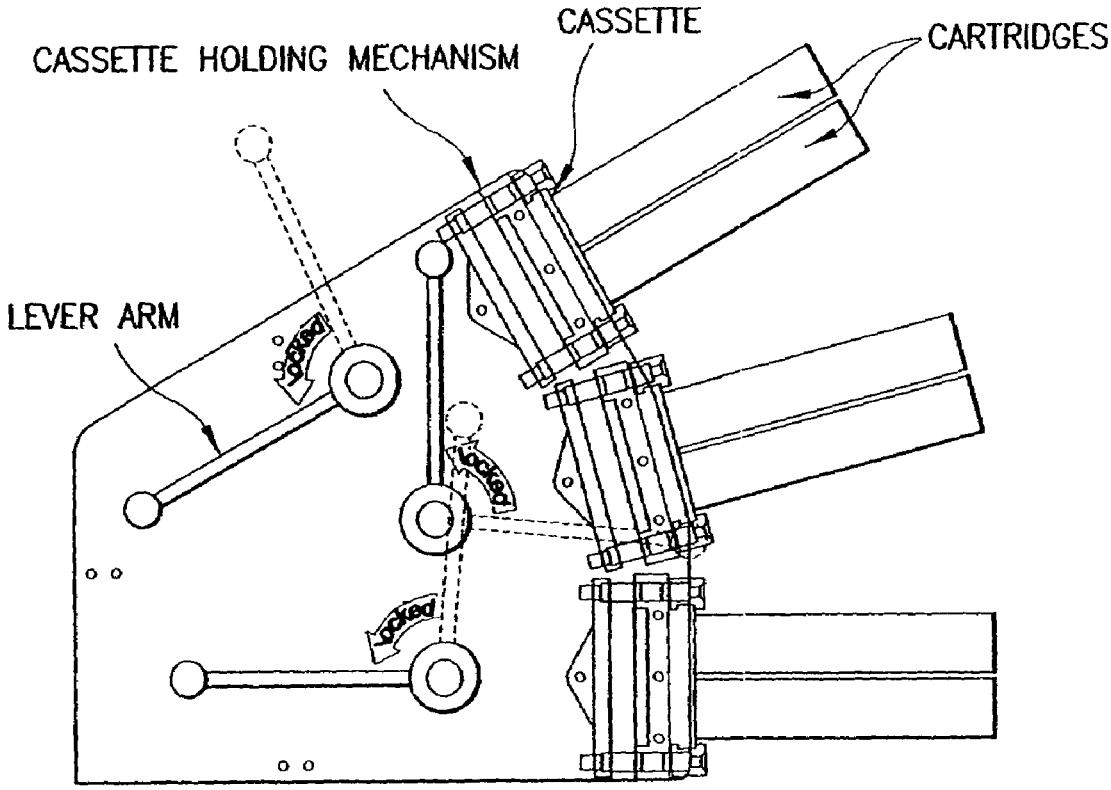
FIG. 2 is a schematic diagram of the multiple projectile launcher according to the presently preferred embodiment of the present invention.

Once the cassette holding the cartridges is loaded into the cassette holding mechanism, the cassette holding mechanism moves the cassette into a locked position in the launcher base. The cassette holding mechanism is moved into locking position by turning the lever arm located on the side of the multiple projectile launcher. The three lever arms on the launcher base can be seen in each of FIGS. 1A/1B/1C/2, where all lever arms are in the locked position. Inside the launcher base, as can be seen in FIG. 2, each lever arm is connected to one of the three cassette-holding mechanisms. When the lever arm is rotated, a sliding assembly within the cassette holding mechanism is slid into the launcher base, thereby moving the cassette into the locked position. In the presently preferred embodiment, each cartridge has an electric igniter for igniting the propellant which will launch the payload out of the cartridge. When the cassette is moved into the locked position, the electric igniters of the cartridges held in the cassette are electrically connected to electric igniter contacts in the launcher base. The electric igniter contacts are controlled via a fire control panel which may be operated by one person (who, in the embodiment shown in FIG. 1A, can remain inside the vehicle during firing, if desired). All of this (and more) will be described in much greater detail below.

It may be noticed that the launcher in FIGS. 1A/1B/1C differs from the launcher in FIG. 2 in the configuration of the lever arms. In FIGS. 1A/1B/1C, each of the three locked lever arms is pointing substantially perpendicularly to the plane of its corresponding cassette. In FIG. 2, the top and bottom lever arms are similarly situated, but the center lever arm is pointing straight up, and thus more near to parallel with its corresponding cassette. Another difference is that the lever arms are on the left-hand side of the launcher in FIGS. 1A/1B/1C, whereas the lever arms are on the right-hand side of the launcher in FIG. 2 (so the lever arms in FIGS. 1A/1B/1C are rotated clockwise into the locked position, whereas the lever arms in FIG. 2 are rotated counterclockwise into the locked position). In other embodiments, the lever arms could be located on the top or bottom of the launcher, and the location of the lever arms may depend on what is most suited for the intended use and location of the launcher.

These are minor variations in how the lever arm may be implemented in one embodiment of the present invention, and it should be understood that a much greater variety of locking and/or sliding mechanisms is possible when implementing the present invention, i.e., any mechanical or electromechanical means for moving the igniter electrodes of the cartridges into contact with the electric igniter contact pins in the launcher base may be used.

The presently preferred embodiment provides one or more security personnel with an area munition, i.e., a means to saturate one or more areas with multiple ordnance, rather than a point munition, i.e., a means to target one point or area with a single ordnance (e.g., a rifle, a grenade launcher, etc.) In comparison, before the present invention, the coordination and synchronization of a large number of security personnel (each brandishing a smoke grenade, or a grenade launcher) was required to provide the same effect. Furthermore, the presently preferred embodiment may be mounted on a vehicle, as shown in FIG. 1A, a building, or an emplacement, and controlled by a wired or wireless fire control system, thereby allowing security personnel to remotely control the ignition of the cartridges while protected within an enclosure or behind defensive works.

Although the presently preferred embodiment of the present invention was designed to deal with the particular problem of launching less-lethal ordnance at large groups of people, it should be understood that the present invention is neither limited to the presently preferred embodiment (as indicated by the other exemplary embodiments discussed throughout the specification), nor limited to the problem of saturating crowds with tear gas. In other words, novel and inventive elements of the present invention may have much wider applicability, and some individual features, or combinations of features, of the present invention may be inventive in their own right. For example, the manner in which the cartridge is held in place in the cassette (which will be described in much greater detail below) may have applicability in other contexts, such as the loading and priming of cartridges in firearms. As another example, the manner in which the cartridges are locked and primed by moving the cartridges so that their igniter electrodes touch the igniter contact pins which remain motionless in the launcher base may also have applicability in other contexts, such as pyrotechnics.

As yet another example of the broader applicability of the present invention, consider the two sets of four smoke grenade launching tubes positioned at the front of the military vehicle in FIG. 1C. These launching tubes are static and have fixed elevations and azimuths: their purpose is to provide cover for the vehicle, i.e., smoke grenades are launched from the tubes so that the smoke produced will hide the motions and activities of the vehicle from the enemy. Each of these launching tubes has a prong located at the center of the bottom of the tube, and when a (specially made) smoke grenade is slid down the muzzle, the prong engages an aperture located on the bottom of the smoke grenade to thereby lock and prime the smoke grenade. To ignite the smoke grenade, an electric charge is applied to the grenade through the prong.

An embodiment of the present invention could comprise a cassette in which four cartridges are held at the approximate azimuths and elevations of the four smoke grenade tubes in FIG. 1C. The launcher base could be the vehicle itself, with the locking being performed by lever arms inside the vehicle or by an automatic electromechanical means. In such an embodiment, it would be possible for personnel to quickly and efficiently reload all four smoke grenades at once. Furthermore, once locked and primed, the smoke grenades would remain protected from the environment by the cartridge case, while the electrodes and contact pins of the electric ignition system would be sealed and thereby protected from the environment. In contrast, the smoke grenade tube in FIG. 1C may allow water and/or other material from the outside environment into the uncovered tube. Furthermore, if a smoke grenade is primed inside the launching tube, water and/or other material from the outside environment could seep around grenade and reach the prong and its electrical connection to the smoke grenade at the bottom of the tube.

This exemplary embodiment is being described in order to emphasize the wide applicability of the present invention, and no suggestion is being made of the utility and/or economy of this particular exemplary embodiment.

A more concise description of the features of the presently preferred embodiment follows.

2. Orientation of the Banks of Cartridges

The launcher shown in FIGS. 1A/1B/1C/2 has each cartridge bank set at a different elevation. The top bank of cartridges has an elevation of about 30°; the middle bank has an elevation of about 15°; and the bottom bank has an elevation of about 0°. Thus, there are three different target areas at varying distances from the launcher which can be reached by less-lethal ordnance launched from the launcher.

One of the advantages of the three-cartridge-banks-at-three-different-elevations configuration of the presently preferred embodiment shown in FIGS. 1A/1B/1C/2 is its ability to saturate a targeted group of antagonists with ordnance (e.g., tear gas); so much so, in fact, that the antagonists will be unable to pick them all up and throw them back at the security personnel who launched the ordnance. Since the banks of cartridges are set at three different elevations, the launcher may saturate a smaller crowd based on its distance from the launcher by firing only one bank of cartridges, or saturate a larger crowd in three different areas by firing all three banks of cartridges at once. The launcher may also fire off each bank as a crowd is rushing at the vehicle, i.e., the top bank of cartridges (at the highest elevation) first when the crowd is the greatest distance away, the middle bank of cartridges second when the crowd has moved midway to the vehicle, and the bottom bank of cartridges last, when the crowd is in the immediate vicinity of the vehicle. Thus, the three-cartridge-banks-at-three-different-elevations configuration is advantageous not only for a crowd rapidly approaching from a distance or a large crowd occupying all three target areas, but also for the chaotic and abruptly-changing conditions that are typical of many crowd control situations.

Although the presently preferred embodiment has three banks of cartridges at three different elevations, other embodiments may have any configuration, i.e., any number of banks of cartridges, at any elevation, and at any azimuth. The three different cartridge banks of the multiple projectile launcher shown in FIGS. 1A/1B/1C/2 have the same fixed azimuth (i.e., although the vertical direction of fire, or elevation, of the banks are different, the horizontal direction of fire, or azimuth, of the banks are the same). However, the launcher of FIG. 1B/2 can be placed on a rotating turret when mounted on a vehicle, as can be seen in FIG. 1A, thereby providing the operator with the ability to change the azimuth of all three cartridge banks at once. Furthermore, the presently preferred embodiment could be turned on its side (so that the lever arms are either on the bottom or the top) in order to provide three different azimuths and only one elevation.

Similarly, the banks of the multiple projectile launcher according to the presently preferred embodiment have three fixed elevations relative to the launcher base (i.e., the operator can only change the three fixed elevations by tilting the entire launcher forward or backward). However, the launcher in FIG. 1B can be placed on a pan-and-tilt mount, thereby allowing the operator to change both the elevation and azimuth of the cartridge banks.

Furthermore, it is contemplated that, in other embodiments of the present invention, the elevation and/or azimuth of one or more cartridge banks may be adjustable relative to the launcher base. However, such embodiments are likely to be far more complicated than the presently preferred embodiment because of all the additional mechanisms that will be required.

Although more complicated embodiments are possible, the presently preferred embodiment benefits from its relative simplicity. Because the elevations and azimuth of the three cartridge banks are fixed, the manufacture of the launcher base with its cassette holding mechanisms is relatively simple. Furthermore, it is believed that the present orientation of the three banks at elevations of about 30°, about 15°, and about 0° provides optimal fields of fire for launching payloads from a launcher mounted on a vehicle or a raised surface ("raised" in relation to the location of the antagonists).

3. Mounting of the Launcher

As referred to above, the multiple projectile launcher according to the presently preferred embodiment shown in FIGS. 1B/2 is built to be mounted atop a structure, such as a building, a tank, a truck, a car, a guardhouse in a prison, etc. In particular, the presently preferred embodiment is intended for placement on a movable turret or stationary mount on top of a vehicle, as seen in FIG. 1A, although it can also be mounted on the side of a vehicle, as shown in FIG. 1C, with the appropriate equipment. When mounted on the exterior of a vehicle capable of carrying personnel in the interior, the firing of the launcher can be controlled by security personnel located within the vehicle, thus allowing the security personnel some protection from the antagonists. In addition, although the elevations of the cartridge banks of the presently preferred embodiment are fixed, the launcher projectiles (i.e., cartridge payloads) can be targeted at different locations by moving the vehicle into different positions.

Although the presently preferred embodiment is intended for a movable turret or a stationary mount on top of a vehicle, a multiple projectile launcher according to the present invention may be mounted in a wide variety of ways. A prototype embodiment was mounted on a unmanned robotic vehicle, where both the vehicle and the launcher can be remotely controlled. Other possible embodiments include: a vehicle roof mount with a trapdoor underneath it so the user could bring the launcher within the truck for reloading (of course, a trapdoor could also be put beside the launcher so that a user could load and reload the launcher from the trapdoor, although this would expose the user to more danger), mounted on a carriage with wheels for manual positioning, and static mounts on or in buildings (e.g., prisons, government buildings, such as embassies or city halls) or emplacements near building or other possible targets of antagonistic crowds. It is contemplated that statically mounted launchers would have maintenance schedules, similar to fire extinguishers, in order to insure the viability of the ordnance and the firing mechanism. As an example of a maintenance schedule, it is also contemplated that the cartridges in statically mounted launchers have a predetermined lifespan, i.e., the cartridges would be replaced, for example, every five years.

4. Fire Control System

In the presently preferred embodiment, the propellant inside of each cartridge is electrically initiated and controlled by a fire control system inside the vehicle. The fire control system is a modified version of a fireworks fire control system and, as such, is very flexible. Please see U.S. Pat. Pub. No. 2003/0116048, which is hereby incorporated by reference, for a discussion of various electric ignition fire control devices (this reference is incorporated with the intention of describing various sorts of electronic firework control systems, and the present invention is in no way, shape, or form, limited by the contents thereof). Using the fire control system, a vehicle-mounted embodiment allows the security personnel within the vehicle to control the firing of each cartridge in the launcher. The operator of the fire control panel can fire one cartridge at a time, all of the cartridges at once, all ten cartridges in a bank (at one elevation), different cartridges with a single bank, different cartridges within all three banks, in different timing patterns, etc. For example, it may be effective, when dealing with a very large crowd which extends from close to the vehicle to fairly far away from the vehicle, to have a ripple timing pattern where each row of five cartridges are fired in sequence starting from the bottom row of the cartridge bank at about 0° elevation and ending at the top row of the cartridge bank at about 30° elevation. Such patterns may be manually performed by the operator or pre-programmed into a processing means (whether hardware, software, firmware, or a mixture thereof) so that an operator need only press one button or switch.

Depending on how the launcher is mounted (and where the operator is located relative to the launcher), the fire control panel may be placed anywhere. The fire control panel may have a wireless link to the rest of the fire control system, thereby allowing the operator equipped with the fire control panel to move freely. In such an embodiment, the fire control panel may be built as a small control device (perhaps with less buttons than a full control panel) which is capable of being easily carried by the operator. Furthermore, it is possible that the fire control system may be integrated into a computer system, e.g., the fire control system being either accessible or controllable through a PDA or laptop computer with which it has a wireless communication link.

Although some exemplary embodiments of a fire control system which may be used with the present invention are discussed herein, it should be noted that it is possible to implement other types of fire control systems in accordance with the present invention. For example, one embodiment of the present invention could use a more rudimentary form of fire control rather than the electronic system described above, or have the fire control system integrated into other control electronics of the vehicle, building, or emplacement to which the launcher is mounted.

It is contemplated that fire control systems in future embodiments may have a mechanism for automatically recognizing the type of ordnance in the cartridge. Thus, in such an embodiment, the operator of the fire control system would be able to determine the types of cartridges loaded into the launcher without having loaded them or even seen them directly. In such an embodiment, the type of ordnance may be indicated on the fire control panel by, for example, different colored lights on a panel or by name and/or icon on a display screen.

5. The Cartridge

Each cartridge is comprised of an electric igniter, propellant, and a payload. The payload in the cartridges of the preferred embodiments of the present invention consist of any less-lethal ordnance capable of being propelled in such a manner, as well as any less-lethal ordnance that is modified so that it may be propelled in such a manner (e.g., tear gas canisters or grenades, sting-balls, flash-bang rounds, bean bags, etc.). Each payload may be comprised of multiple or mixed ordnance, i.e., one cartridge may have multiple tear gas grenades or a combination of tear gas and concussion grenades. Although the payload in the cartridges of the preferred embodiment of the present invention may consist of any less-lethal ordnance, the cartridge payload of other embodiments may have ordnance of a more lethal character.

Furthermore, although the cartridges in the presently preferred embodiment have payloads which are propelled by the ignition of propellant contained in the cartridge, other cartridges may have payloads which are self-propelling (such as rockets) or which do not propel at all, but are intended to ignite and discharge within the cartridge case (such as a smoke grenade when the intention is to surround the launcher with smoke, or to discharge the smoke at antagonists directly adjacent to the launcher).

Figure 3A:
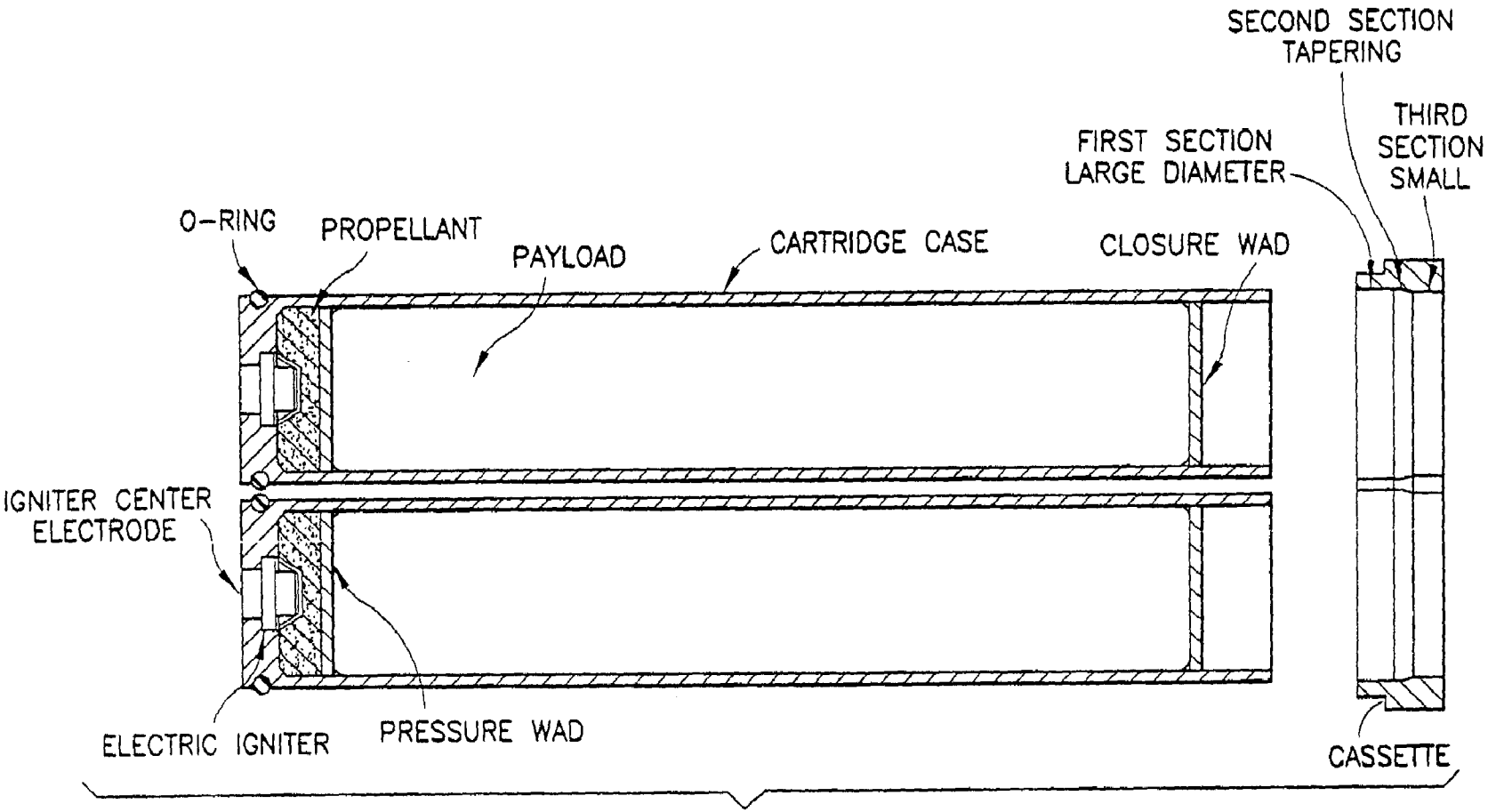
FIG. 3A is a schematic diagram of a cross-section of two cartridges and a cassette according to the presently preferred embodiment of the present invention.

A cross-section of two cartridges according to the presently preferred embodiment is shown and labeled in FIG. 3A: as discussed above, each cartridge is comprised of an electric igniter, propellant, and a payload. In particular, each cartridge is comprised of an igniter electrode, an electric igniter positioned next to the propellant, a payload separated from the propellant by a pressure wad and enclosed at the open end of the cartridge case with a closure wad. A cartridge according to the presently preferred embodiment is roughly 9 inches long, with a diameter of roughly 1⅝ inches. Each cartridge also has a rubber O-ring located at its locking end, which is used to form a friction seal with a cassette hole, and also forms a water-tight seal when the cassette is locked into position, as will be discussed below. The O-ring is located roughly ⅜ inch in from the end of the cartridge.

The cartridge case of a cartridge according to the presently preferred embodiment has a roughly cylindrical shape which is relatively simple (and thus economical) to manufacture. As will be seen below, the simple addition of an O-ring to the outer circumference of a rear portion of the cartridge case provides the means for holding the cartridge in place in the cassette as well as a means for forming a seal which protects the parts of the electrical ignition from the environment of the launcher. An earlier embodiment used a rim protruding from the rear portion of the cartridge case; however, the rim did not form a friction seal with the cassette until the cassette was locked in the launcher base, so the cartridges could fall out of a cassette before loading onto the launcher if the cassette was held upside down (or at an angle sufficiently close to upside down). Furthermore, an embodiment with a rim on the cartridge case is more difficult (and thus more expensive) to manufacture, and cannot guarantee as impermeable a seal against the environment as the O-ring.

Other embodiments of the present invention could have the diameter of the cartridge case increase towards the rear of the cartridge case relative to the other portions of the cartridge case such that the rear of the cartridge case would not be able to pass through the slots in the cassette. However, such embodiments would be more difficult (and thus more expensive) to manufacture, would suffer from the same problem as the rimmed cartridges, i.e., falling out of the cassette when the cassette is held at a sufficiently great angle, and could not guarantee as impermeable a seal against the environment as the O-ring.

6. Loading and Priming the Multiple Projectile Launcher

A description of the loading and priming of the multiple projectile launcher according to the presently preferred embodiment follows, with reference to the accompanying drawings.

(A) Loading Cartridges onto Cassettes

Loading the cartridges into the cassette in the presently preferred embodiment is relatively simple: each cassette has ten appropriately shaped holes or slots for cartridges, and each cartridge has a rubber O-ring on its locking end which forms a friction seal with the inner surface of any of the holes or slots in the cartridge.

Figure 4A:
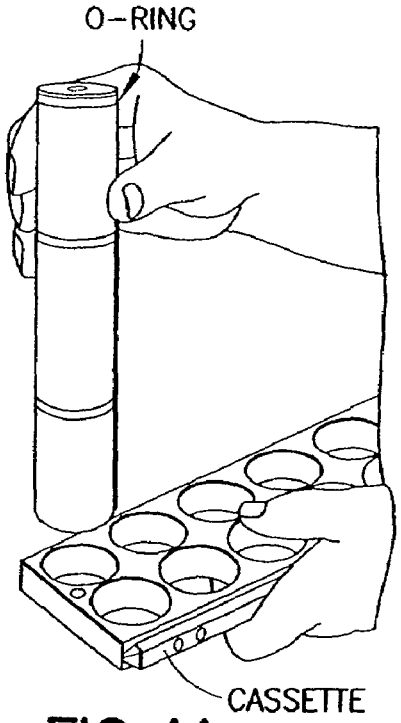
FIGS. 4A, 4B, and 4C provide an external view of a cartridge being pushed into place in a cassette hole according to the presently preferred embodiment of the present invention, and correspond to the inserting and securing shown schematically in FIGS. 3A-3B-3C.

Besides showing the cross-sections of two cartridges according to the presently preferred embodiment, FIG. 3A also shows a cross-section of the cassette, and, more particularly, the cross-section of the two slots into which the two cartridges are poised to be inserted. FIGS. 3A/3B/3C show cross-sections of the two cartridges and the two slots in the cassette as the cartridges are inserted and then securely lodged (or loaded) into the slots; likewise, FIGS. 4A/4B/4C provide an external view of the same insertion and loading (or lodging) of the cartridges in the cassette.

Figure 3B:
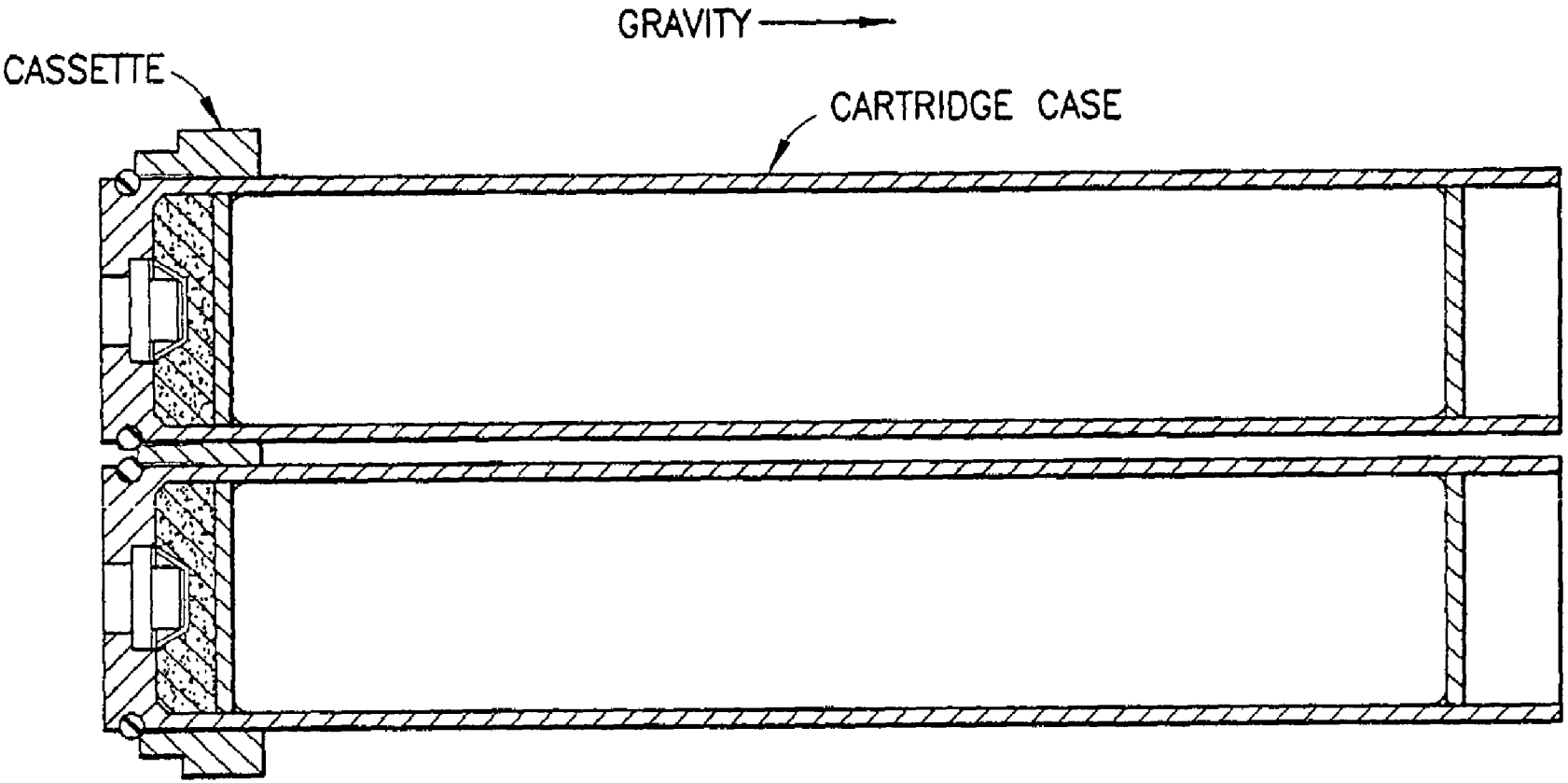
FIG. 3B is a schematic diagram of a cross-section of two cartridges placed into the holes of a cassette, and resting thereon, according to the presently preferred embodiment of the present invention.
Figure 4B:
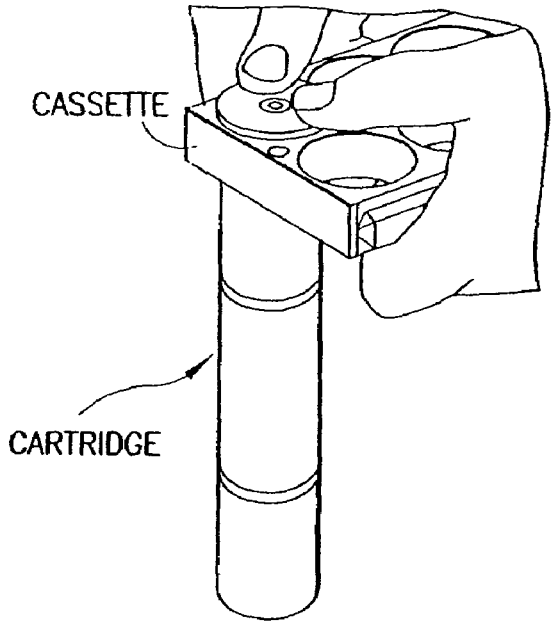
Figure 4C:
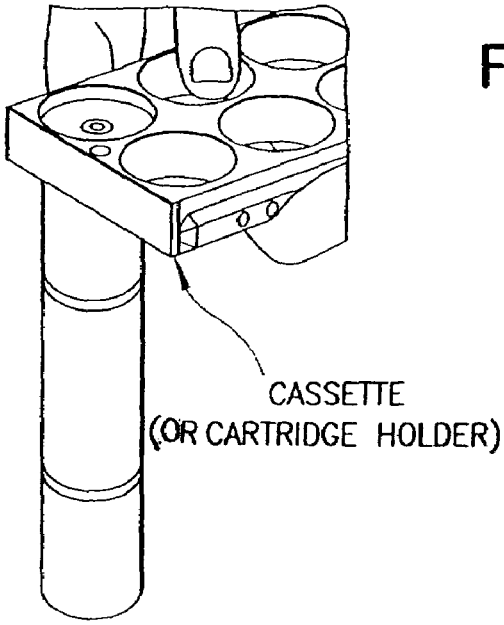

As stated above, the cartridges in FIGS. 3A/4A are shown poised to be inserted into the holes or slots in the cassette. In FIG. 4B, the cartridge can be seen resting on the cassette slot or hole; a schematic cross-section corresponding to FIG. 4B is shown in FIG. 3B. In FIGS. 3B/4B, the O-rings of the cartridges can be seen resting on the outer lips of the cassette holes (or slots). As shown most clearly in the schematic cross-section of FIG. 3A, the inner surface of each cassette hole or slot is comprised of three sections. The first section, at the loading end of the hole, has the largest diameter; the second section has a conical shape (i.e., the diameter is decreasing); and the third section has the smallest diameter. The difference in diameter between the largest diameter and the smallest diameter is roughly 2/32 inch.

Figure 3C:
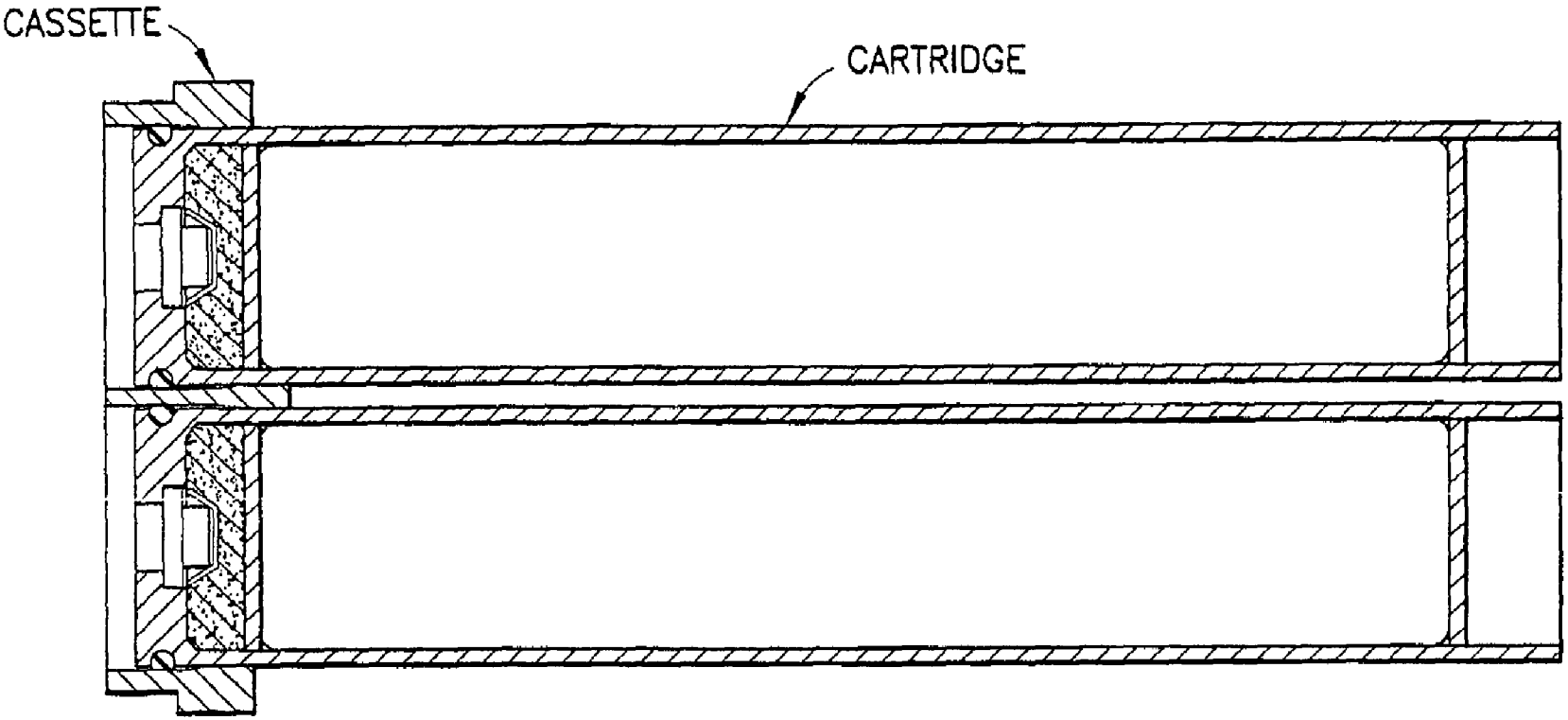
FIG. 3C is a schematic diagram of a cross-section of two cartridges firmly lodged within the holes of a cassette according to the presently preferred embodiment of the present invention.

The O-rings of the cartridges have a larger diameter than the diameter of the loading end of the cassette hole, as can be seen in FIGS. 3B/4B, where the cartridge is resting on top of the cassette hole. However, the O-ring of the cartridge can be forced into the loading end of the cassette hole, if adequate pressure is applied. This process of securely lodging the cartridge into the cassette hole or slot may be performed by pushing the cartridge into the slot with both thumbs, so that the O-ring forms a friction seal with the inner surface of the first section of the cassette hole, can be seen in FIGS. 3C/4C. Thus, in FIGS. 3B/4B, the cartridge is still resting on the outer lip of the cassette hole; in FIGS. 3C/4C, the cartridge has been firmly lodged within the cassette hole.

It should be understood that the present invention is not limited to this technique of cartridge loading/holding, and any technique or technology for holding cartridges in the cassettes may be employed in accordance with the present invention. For example, a notch-and-detent type system where the cassette holes have a notch and the cartridge had a detent (or vice-versa) could be employed. In an earlier embodiment, the cartridges were be clamped onto the cassette, but this was not preferable, for reasons discussed below.

(B) Loading Cassettes onto the Launcher

Figure 5A:
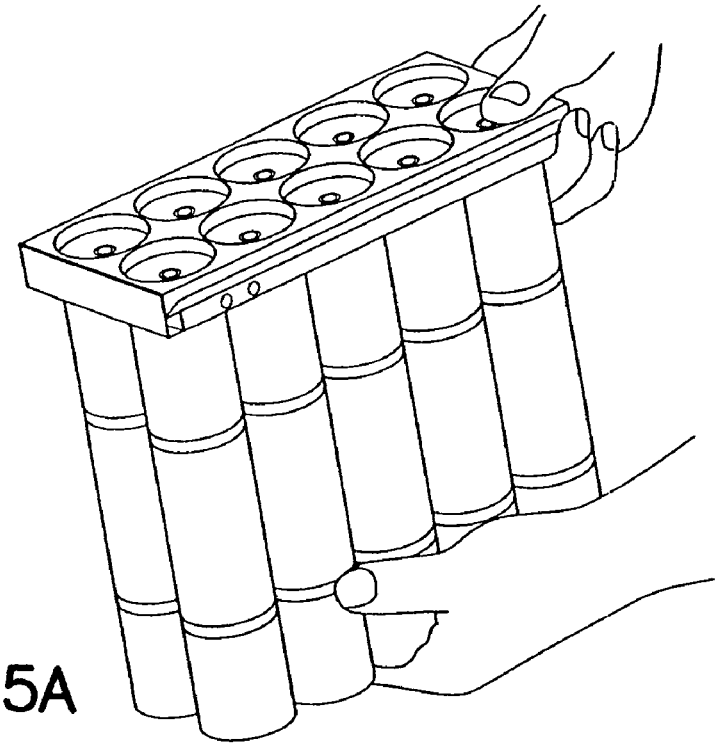
FIGS. 5A and 5B show a fully loaded cassette and the top cassette loading mechanism in the launcher, respectively, according to the presently preferred embodiment of the present invention.
Figure 5B:
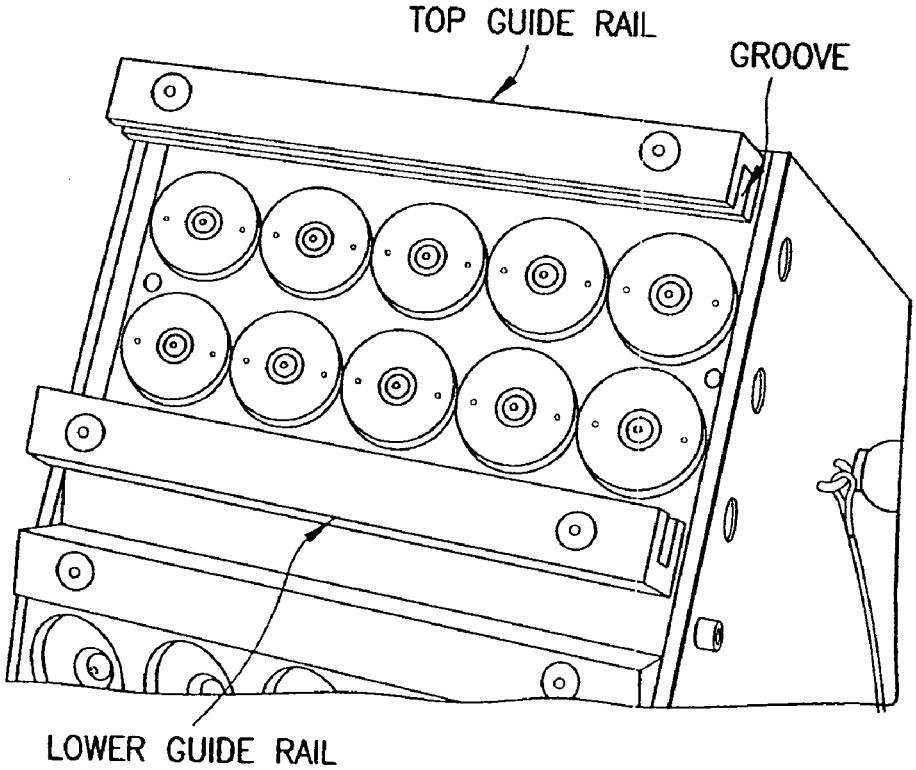

FIG. 5A shows a fully loaded cassette, ready for insertion into the cassette holding mechanism of the launcher, and FIG. 5B shows the top cassette holding/loading mechanism (presently empty) in the launcher according to the presently preferred embodiment of the present invention. The top cassette holding/loading mechanism in FIG. 5B has upper and lower guide rails that contain grooves into which the cassette slides. The cassette in FIG. 5A has ribs on both sides (only one can be seen) which fit into the grooves of the loading mechanism. The ribs on the cassette and the grooves in the cassette holding/loading mechanism differ enough in width to provide sufficient play between the rib and the groove for it to be relatively easy to insert the cassette into the grooves of cassette loading mechanism. In addition, the ends of the grooves (the opening where the ribs of the cassette enter) widen considerably so that it is easy to thread the ribs into the grooves. Thus, the person loading the cassette is not required to carefully thread the cassette into the grooves of the sliding mechanism. This is advantageous, for it allows the person loading the launcher to brusquely shove the cassette into place, as may be appropriate during a conflict with antagonists.

Figure 6A:
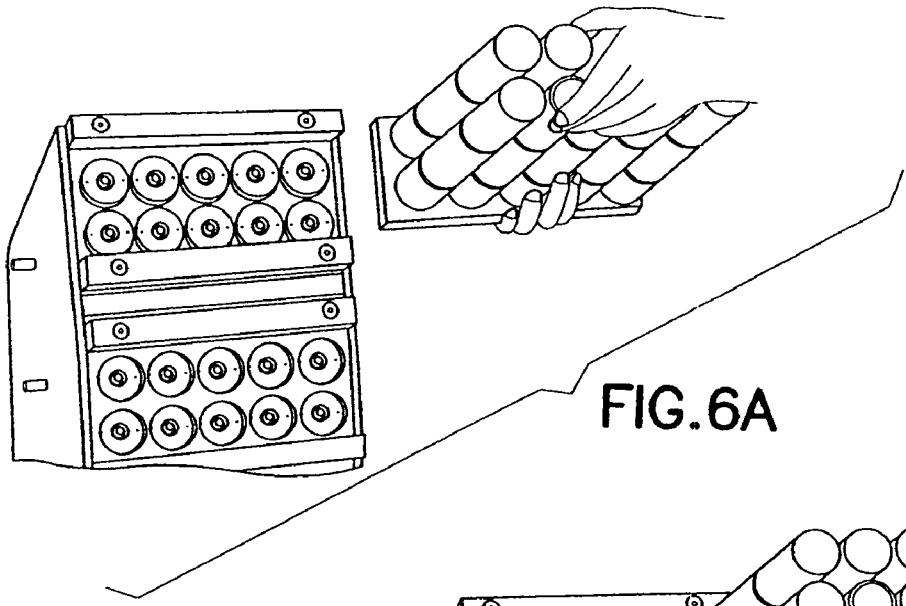
FIGS. 6A, 6B, and 6C show a cassette being inserted into a launcher according to the presently preferred embodiment of the present invention.
Figure 6B:
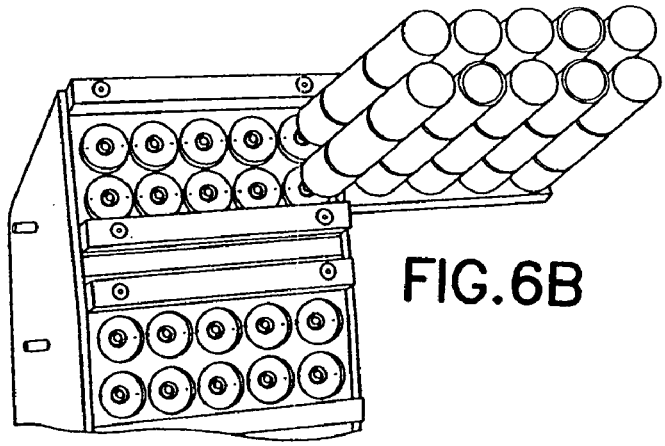
Figure 6C:
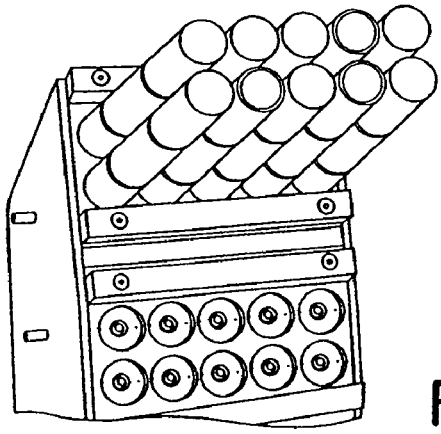

FIGS. 6A, 6B, and 6C show the fully loaded cassette being inserted into the top loading mechanism of the launcher according to the presently preferred embodiment of the present invention. A previous embodiment of the system had the cassette being clamped into position directly onto the launcher base. The presently preferred system is easier, and safer as well, because the person loading the cassette must do so from the side of the launcher, whereas, in the previous embodiment, the person loading could become perilously close to the firing ends of the cassettes, and may even be directly in the firing path of the cartridges in the cassette, when clamping them onto the launcher base.

Figure 7A:
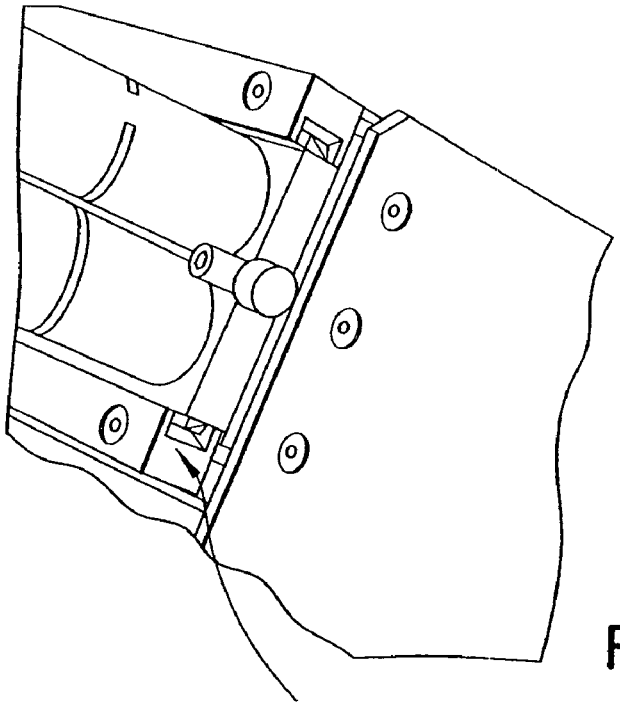
FIG. 7A shows a fully loaded cassette completely inserted into the loading mechanism of the launcher, but not locked, according to a presently preferred embodiment of the present invention.
Figure 7B:
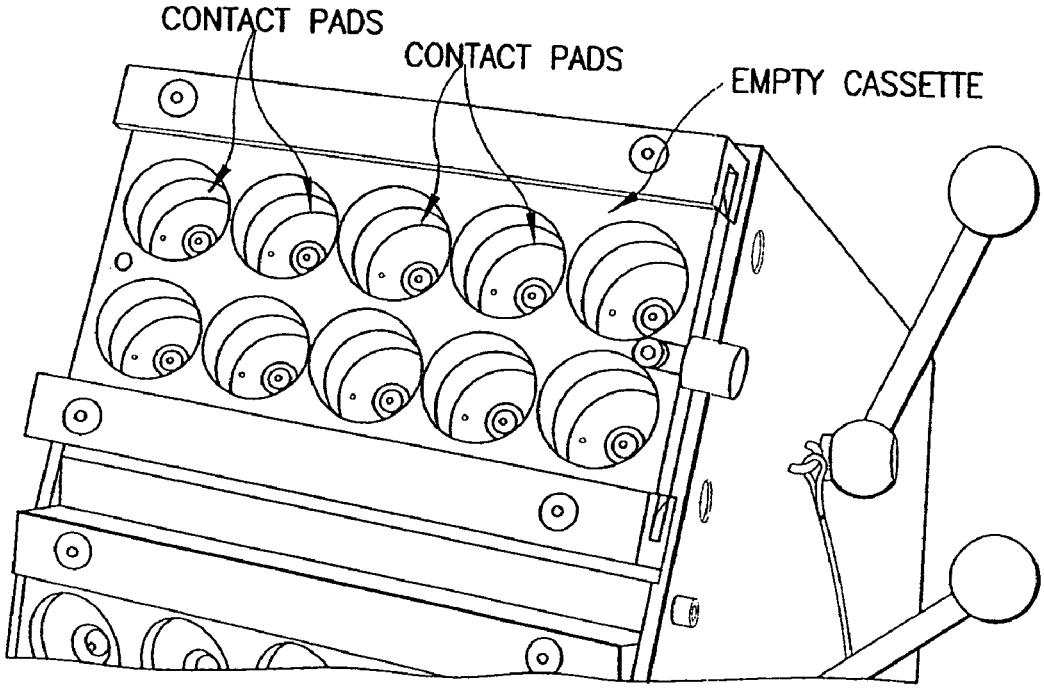
FIG. 7B shows an empty cassette completely inserted into the loading mechanism of the launcher, but not locked, according to the presently preferred embodiment of the present invention.

FIG. 7A is a close-up of the side of the top cassette loading mechanism with the fully loaded cassette fully inserted. The widened ends of the grooves can be more clearly seen in FIG. 7A. Also, a gap between the cassette and the launcher base can be seen, thus showing that the cassette is not locked, and the cartridges are not primed. FIG. 7B shows an empty cassette fully inserted into the top loading mechanism, but not locked. In FIG. 7B, it can be see that there is a "contact pad" in the launcher base underneath each cassette hole (and, thus, under the locking end of each cartridge in FIG. 7A).

Figure 8:
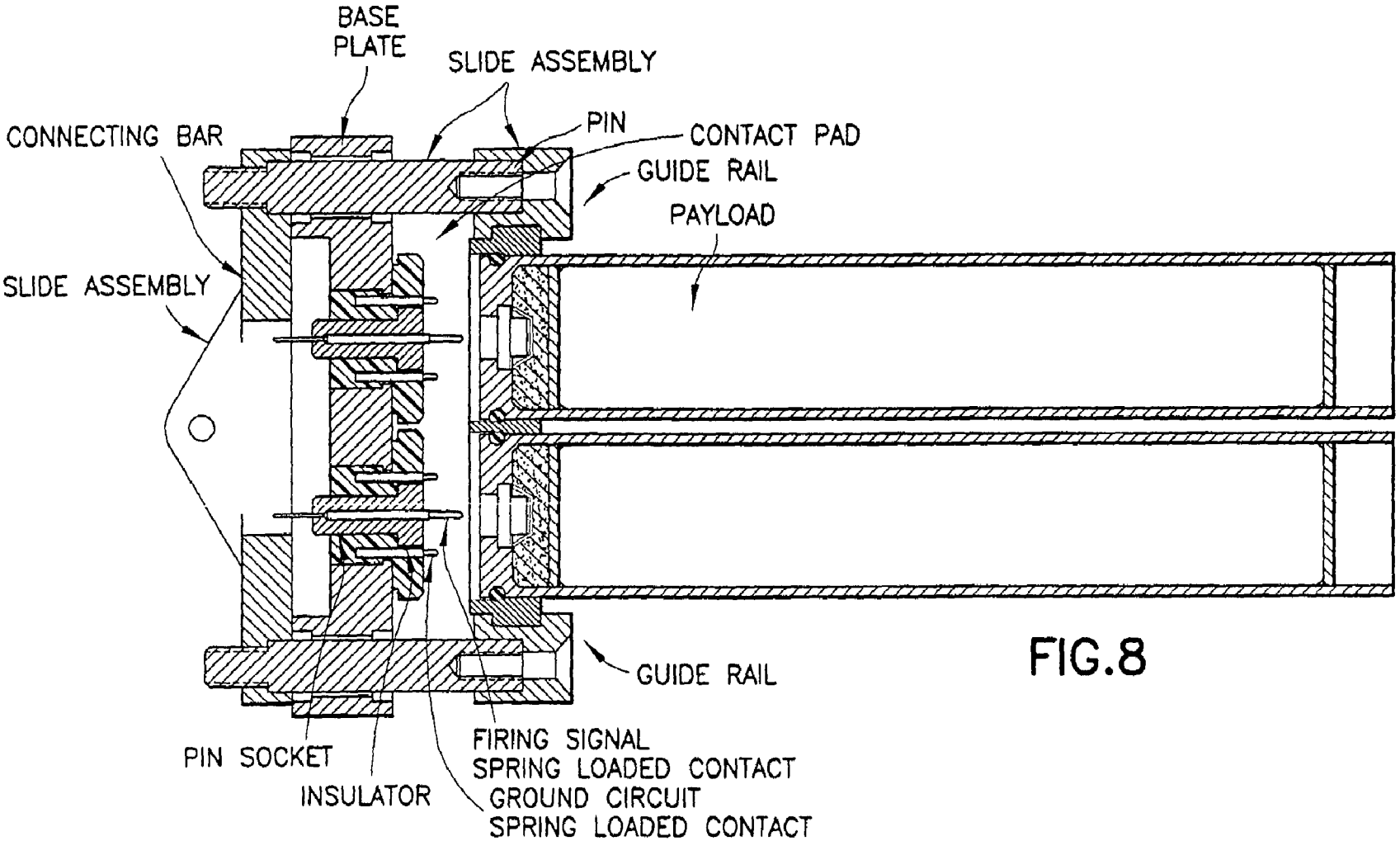
FIG. 8 is a schematic diagram of a cross-section of a cassette (loaded with two cartridges) fully inserted into the launcher, but not locked, similarly to FIGS. 6C and 7A, according to the presently preferred embodiment of the present invention.

A cross-section schematic diagram corresponding to FIGS. 6C and 7A (i.e., a fully loaded cassette fully inserted in the launcher, but not locked and primed) can be seen in FIG. 8. The ribs of the cassette are set into the grooves of the guide rails of the slide assembly. The igniter center electrode of each cartridge is poised over a spring-loaded firing contact in the corresponding contact pad set in the base plate of the launcher base. Since the cassette is not locked, and the cartridges are not primed, there is a certain distance between each firing contact and igniter electrode. Each contact pad set in the base plate comprises the spring-loaded firing contact, an insulator surrounding the pin socket holding the spring-loaded firing contact, and two matching spring-loaded ground contacts. In the presently preferred embodiment, the insulator is polycarbonate or delrin.

It should be understood that the present invention is not limited to either technique of cassette loading discussed above (i.e., sliding into grooves or clamping directly onto the launcher base), and that any technique or technology for loading cassettes into place on the launcher base may be employed in accordance with the present invention.

(C) Locking/Priming the Cassettes

Figure 11:
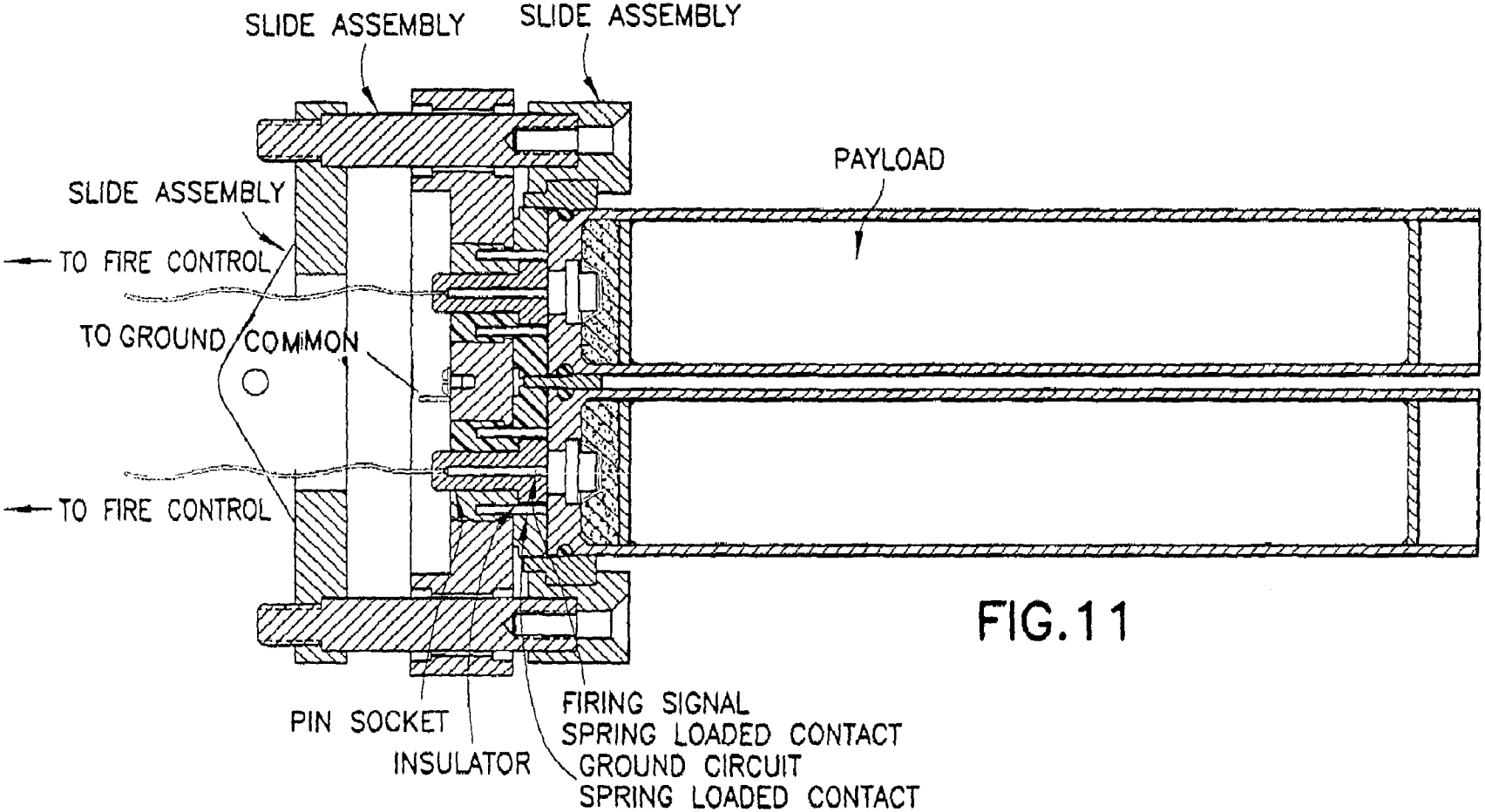
FIG. 11 is a schematic diagram of a cross-section of a cassette (loaded with two cartridges) locked onto the launcher, thereby priming the cartridges, corresponding to FIG. 10B, according to the presently preferred embodiment of the present invention.

Once the cassette is fully loaded into the sliding mechanism (as shown in FIG. 8), it is locked in place (and primed) by rotating the lever arm (as shown in FIG. 2) corresponding to the cassette into the locked position. The lever arm pulls the sliding mechanism (with the cassette held in its grooves) within the cassette holding mechanism into the launcher base (as shown in FIG. 11, described more fully below). As shown in FIG. 8, electrical initiator pin assemblies are set in the launcher base such that for each cartridge in the cassette, there is a corresponding initiator pin disposed in the launcher base opposite to the igniter electrode of the cartridge.

Figure 9A:
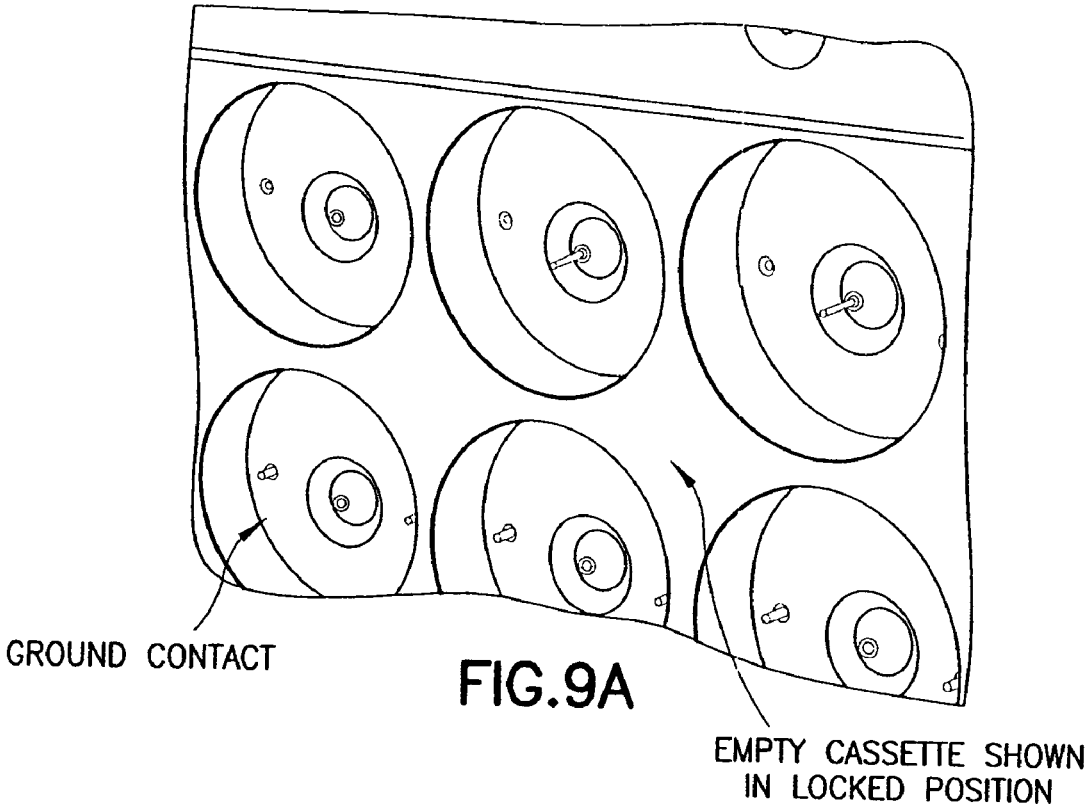
FIGS. 9A and 9B show two different views of the contact pads in the base plate of the launcher base according to the presently preferred embodiment of the present invention.
Figure 9B:
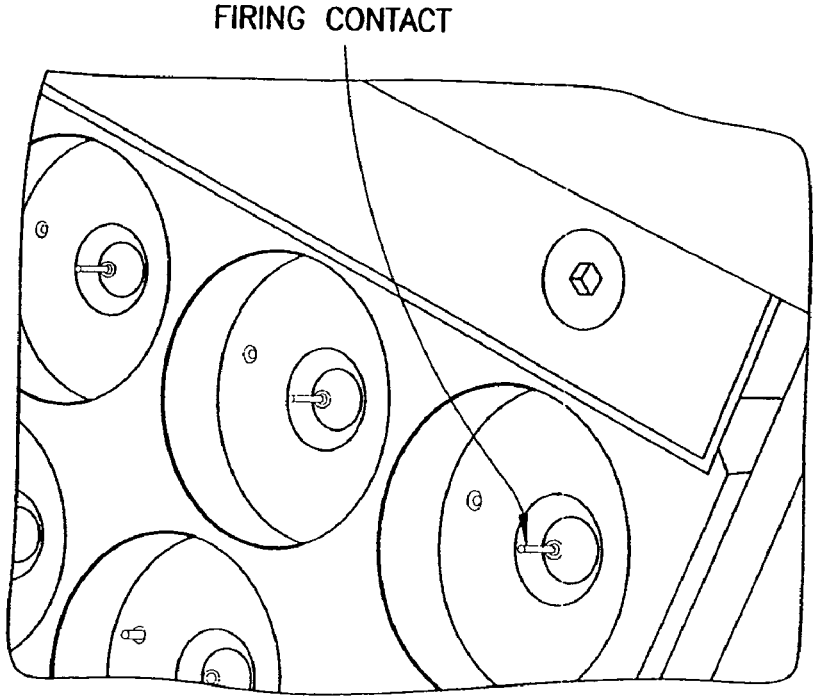

FIGS. 9A and 9B are close-up views of the contact pads in the base plate of the launcher base according to the presently preferred embodiment of the present invention. The contact pads in FIGS. 9A and 9B differ from the contact pads in FIG. 8 in the placement of the spring-loaded ground contact pins relative to the firing contact pin. In FIGS. 9A and 9B, the spring-loaded ground contact pins are horizontally located in relation to the firing pin (i.e., to the sides of the firing pin); whereas, in FIG. 8, the spring-loaded ground contact pins are vertically located in relation to the firing pin (i.e., to the top and bottom of the firing pin).

These are minor variations, and both configurations are possible when implementing the presently preferred embodiment of the present invention, as well as many others (e.g., ground contacts located diagonally from the firing pin; a single ground contact rather than two; the firing pin not located in the center of the contact pad, provided the igniter electrodes on the cartridges are also appropriately moved; etc.). Furthermore, it should be understood that a much greater range of contact pads and contact pad configurations are possible when implementing other embodiments of the present invention, including replacing the contact pads completely with another mechanism.

The contact pads in FIG. 8 are set into the base plate of the launcher base, and, thus, are immovable. By contrast, the fully loaded cassette loaded into the guide rails of the slide assembly in FIG. 8 is movable because the slide assembly can move in relation to the launcher base. Specifically, in the slide assembly, the upper and lower guide rails (which hold the cassette) are attached to stainless steel pins which extend through holes in the base plate of launcher base, where said pins are connected to a connecting bar inside of the launcher base. As can be seen in FIG. 8, the connecting bar has a triangular extension that extends further into the launcher base and has a circular hole in it. The hole in this triangular extension is used as a connection means for the lever arm mechanism, i.e., when the lever arm is rotated, this triangular extension is pulled into the launcher base, which thusly moves the entire slide assembly, including the cassette held in the guide rails, in that direction.

When the sliding mechanism is locked into place, firmly engaging the cassette and the cartridges therein, each electric initiator pin is placed in direct contact with its corresponding igniter electrode, thereby priming each cartridge, as will be described below in reference to FIGS. 10A/10B/11.

Figure 10A:
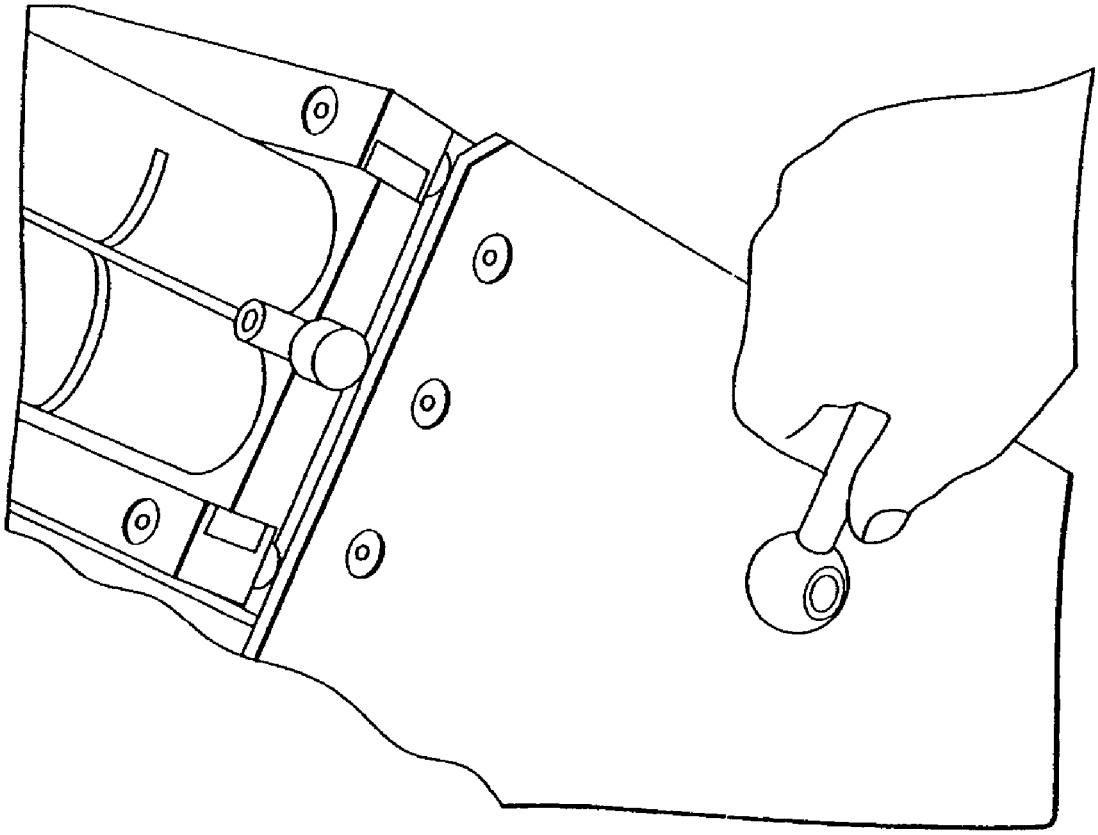
FIG. 10A shows the lever arm corresponding to the top loading mechanism in the launcher about to be rotated in a clockwise direction in order to lock the cassette in place on the launcher according to the presently preferred embodiment of the present invention.
Figure 10B:
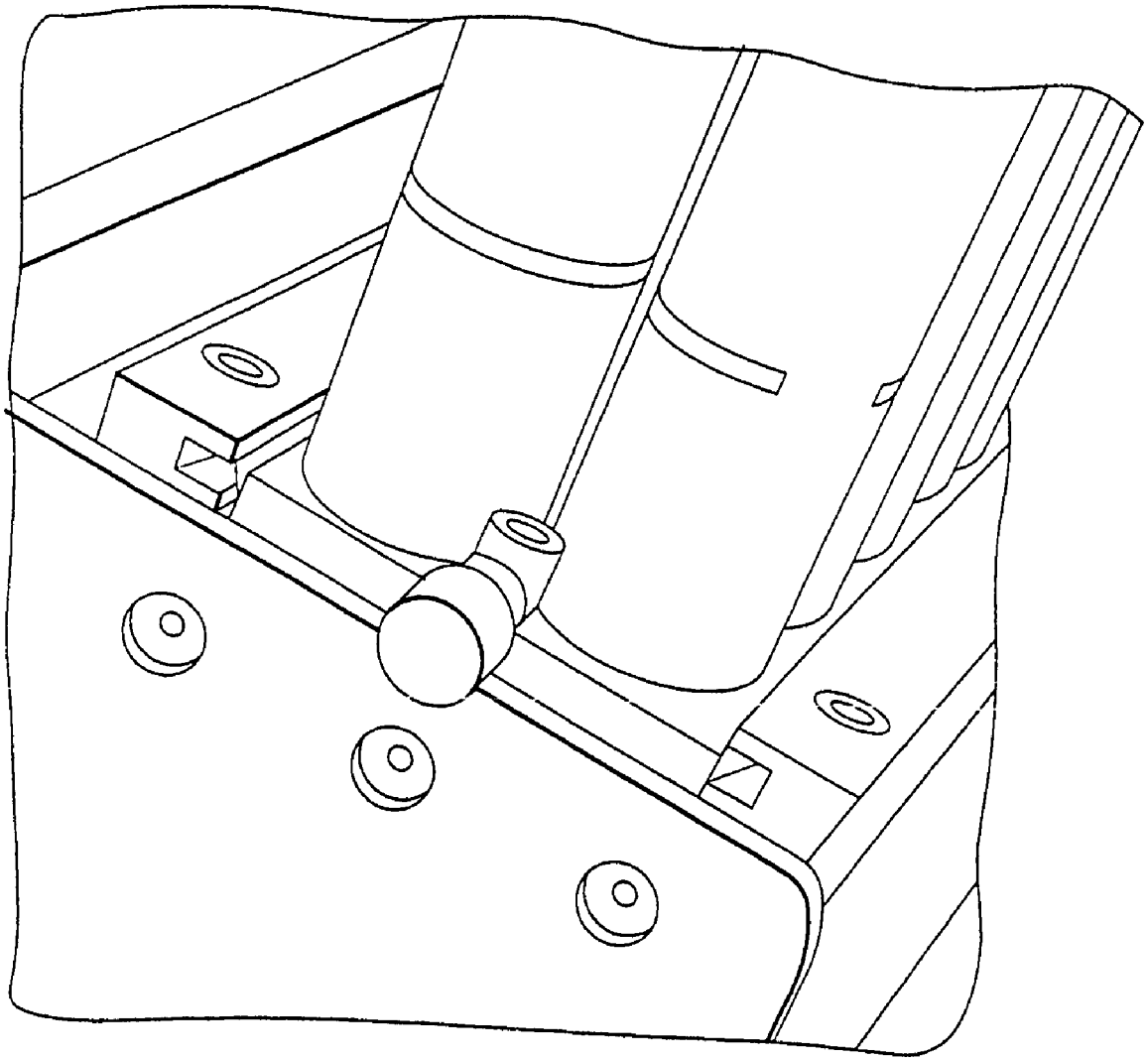
FIG. 10B shows a closer view of a full cassette locked in position on the launcher according to the presently preferred embodiment of the present invention.

FIG. 10A shows a hand grasping the lever arm corresponding to the top loading mechanism in the launcher base, about to pull the lever arm down, clockwise, thus locking the cassette in place on the launcher. FIG. 10B shows the cassette now locked in position (FIG. 10B is a close-up similar to FIG. 7A, except that the cassette in FIG. 10B is locked, and the cassette in FIG. 7A is not). A cross-sectional schematic diagram corresponding to FIG. 10B (i.e., a fully loaded cassette locked on the launcher) can be seen in FIG. 11. In FIG. 11, the entire slide assembly has been pulled toward the launcher base, placing the igniter electrodes of the cartridges in contact with the spring-loaded firing pin contacts, thereby priming each of the cartridges. Because the cartridges are now firmly pressed against the contact pads in the base plate, the spring-loaded contacts in the contact pad are almost fully retracted.

In FIG. 11, it is to be noted that the third section of the cassette hole, with the smallest diameter, fits snugly around the contact pad, creating a sufficiently close seal. Furthermore, by locking the cassette into the launcher, the contact pad has pushed the cartridge even further into the cassette hole, resulting in the O-ring of the cartridge moving from the first section to the second, narrowing, section of the cassette hole, thereby creating an even tighter seal between the cassette and the cartridge (or more exactly, the O-ring and the interior surface of the cassette hole). Between the seal formed by the cassette hole and the contact pad of the launcher and the seal formed by the cassette hole and the O-ring of the cartridge, the various electric contact points and electrodes forming the electric initiating mechanism for the cartridge are protected from the outside elements. Thus, once the cassettes have been locked, the launcher may be left outside, even in the rain, snow, etc., because the effectively water-tight seal will ensure that the electric initiating mechanism will remain dry. Note also, in FIG. 11, that the firing contact pins in the contact pads are connected by wire with the fire control system, and that the base plate is grounded to a common ground.

It is believed that the priming mechanism of the presently preferred embodiment of the present invention is unique in that the initiator pin is set into the base, and thus remains still, while the cartridge (with its igniter electrode) is moved in position in order to be primed. In most systems, it is the cartridge that remains still while the initiator is moved in order to prime the cartridge.

Furthermore, the locking/priming system according to the presently preferred embodiment of the present invention effectively forms a water-tight seal when locked so that, if the launcher is outside and exposed to the weather, no water can leak in and short the electrical initiating mechanism.

Figure 12A:
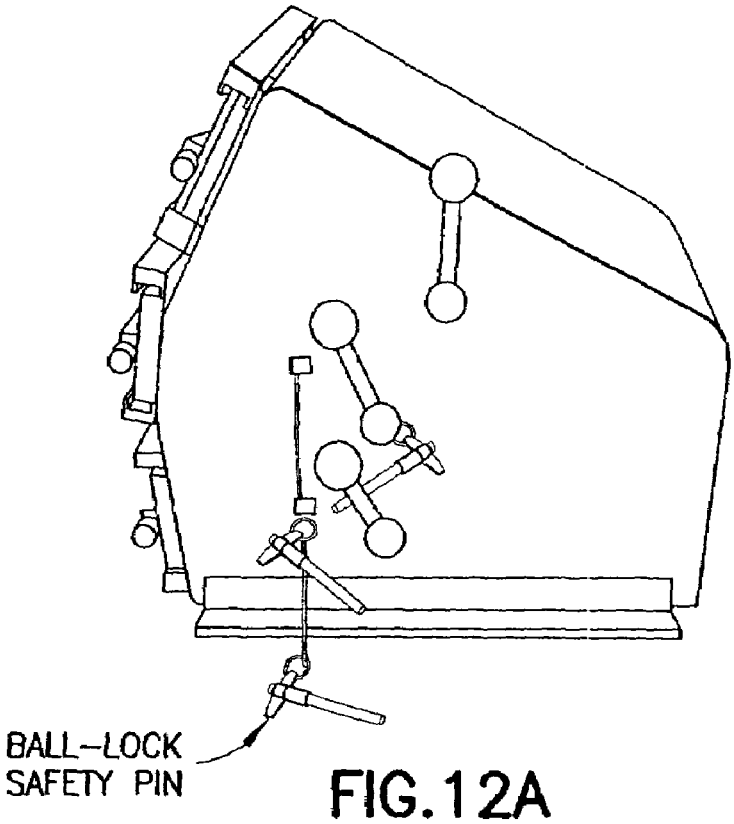
FIG. 12A shows the launcher, with its cassette holding mechanisms loaded with empty cassettes, but not locked, according to the preferred embodiment of the present invention.
Figure 12B:
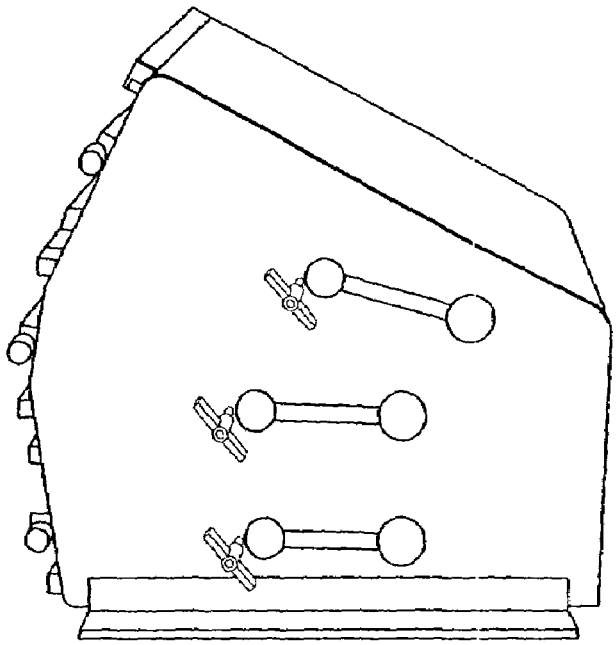
FIG. 12B shows the launcher, with its cassette holding mechanisms loaded with empty cassettes, and locked into position, according to the preferred embodiment of the present invention.

FIG. 12A shows the multiple projectile launcher according to the preferred embodiment of the present invention with three empty cassette inserted into the sliding assemblies of the launcher base, but not locked into place, as can be seen by the positions of the sliding assemblies and the three lever arms. FIG. 12B shows the launcher with the three empty cassettes locked into position, as can be seen from the positions of the sliding assemblies and the three lever arms. In FIG. 12A, the lever arms are in the unlocked position, i.e., substantially perpendicular to the ground, and three ball-lock safety pins can be seen dangling down from wires connected near each lever arm. In FIG. 12B, these ball-lock safety pins have been inserted in three holes, where each hole corresponds to one of the lever arms and the hole is located immediately adjacent to where the lever arm connects to the launcher base. When engaged (by inserting them in their appropriate holes), these three ball-lock safety pins serve to constrain their matching lever arms (and thus the corresponding sliding assemblies) in position. Thus, it is necessary for these safety pins to be removed before locking the cassettes and priming the cartridges. Furthermore, when in place, these safety pins will prevent locked and primed cartridge-loaded cassettes from becoming unlocked.

Although the locking/priming technique has been discussed in terms of the presently preferred embodiment, it should be understood that the present invention is not limited to this technique of locking/priming, and that any technique or technology for locking the cassettes into place and priming them may be employed in accordance with the present invention. For instance, an embodiment is contemplated in which a motorized mechanism, when prompted by the operator, automatically locks and primes the cassettes, thereby replacing the lever arms.

7. Modular Launcher System

In one embodiment, a multiple projectile launcher according to the present invention comprises a modular unit with a single bank of cartridges, i.e., one set of contact pads for one set of cartridges held in one cassette (which, in turn, is loaded into one cassette holder appropriately positioned above the contact pads in the launcher base). This modular launcher unit may be detachably yet securely attached to other modular launcher units to create a larger multiple projectile device having banks with various elevations and/or azimuths. In this manner, the modular launcher units may be connected together to effect a desired spread of fire, a desired number of launchable munitions, a desired combination of elevations, or any desired configuration. The detachably attaching means could comprise any means known to one skilled in the art, from screws, bolts, and locking nuts, to male-female pair locking assemblages mounted on the sides, top, and/or bottom. Moreover, the modular system would have other types of units besides launcher units, such as a wedge unit, which would be placed between two modular launching unit so that one launching unit would have a different elevation than another (or different azimuth, depending on the relative orientation of the configuration to the surrounding environment). In one implementation of this embodiment, fire control would be "plug-n-play", i.e., the set of electrical connections to the electric igniter contacts in the launching modular unit would be able to plug into a fire control system as it is added to the configuration.

While there have shown and described and pointed out fundamental novel features of the invention as applied to a presently preferred embodiment thereof, it will be understood that various omissions and substitutions and changes in the form and details of the components illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A multiple less-lethal projectile launcher comprising:

a launcher base comprising:

a first cassette bank having a first elevation and a first azimuth, comprising:

a first movable cassette holding mechanism configured to receive a cassette of cartridges, said cassette comprising a substantially planar body having slots, wherein each slot is for holding a cartridge, and wherein each of said cartridges comprises an electric igniter, propellant, and a payload; and a first plurality of contact pads, wherein each contact pad comprises an electric igniter contact and corresponds to one of the slots in the cassette, and wherein the cartridges of a cassette loaded into the first movable cassette holding mechanism may be primed by moving said cassette such that the electric igniter contacts of the contact pads make electrical contact with the electric igniters of the cartridges;

a second cassette bank having a second elevation and a second azimuth, wherein (i) said second elevation is different than said first elevation, and/or (ii) said second azimuth is different than said first azimuth, comprising:

a second movable cassette holding mechanism configured to receive the cassette of cartridges; and a second plurality of contact pads, wherein each contact pad comprises an electric igniter contact and corresponds to one of the slots in the cassette, and wherein the cartridges of a cassette loaded into the second movable cassette holding mechanism may be primed by moving said cassette such that the electric igniter contacts of the contact pads make electrical contact with the electric igniters of the cartridges;

wherein one or more cartridges primed in the first and/or second cassette bank may be fired by applying an electric charge to the electric igniters of said one or more cartridges through the electric igniter contacts of the contact pads of the first and/or second cassette bank; and whereby a plurality of payloads may be substantially simultaneously launched into two different areas.

2. The multiple projectile launcher of claim 1, wherein each of the first and second movable cassette holding mechanisms comprises:

at least one guide rail for releasably engaging the cassette, wherein the cassette is loaded onto said launcher base by engaging said at least one guide rail.

3. The multiple projectile launcher of claim 2, wherein at least one lateral side of the cassette has a protruding lip.

4. The multiple projectile launcher of claim 3, wherein said at least one guide rail comprises:

an inner track capable of engaging the protruding lip of the cassette, wherein the cassette is loaded into said each of the first and second movable cassette holding mechanisms by threading the protruding lip of the cassette onto the inner track of the at least one guide rail.

5. The multiple projectile launcher of claim 1, wherein each of the first and second movable cassette holding mechanisms comprises:

a sliding mechanism for moving a cassette loaded into said movable cassette holding mechanism such that the electric igniter contacts of the contact pads make electrical contact with the electric igniters of the cartridges held in the cassette.

6. The multiple projectile launcher of claim 5, wherein motive power for moving the sliding mechanism is provided by an electric motor, an air piston, and/or a user of the multiple projectile launcher.

7. The multiple projectile launcher of claim 5, wherein each slot on a loading side of the cassette and each contact pad of each of the first and second cartridge banks are constructed such that, when the cassette is locked, at least a top portion of each contact pad is partially inserted inside the corresponding slot on the loading side of the cassette and in physical contact with a locking end of the cartridge in the corresponding slot.

8. A multiple projectile launcher system comprising:

a plurality of cartridges, each cartridge comprising an electric igniter and a payload;

a cassette comprising slots, wherein each slot is for holding one of said plural cartridges; and a launcher base comprising a movable cassette holder configured to receive said cassette of plural cartridges, and a plurality of contact pads, each contact pad comprising an electric igniter contact;

wherein, after said cassette holding said plural cartridges is loaded into the movable cassette holder, the plural cartridges may be primed by moving said movable cassette holder holding said cassette such that the electric igniter contacts of the contact pads make electrical contact with the electric igniters of the plural cartridges;

whereby said cartridges may be fired by applying an electric charge to the electric igniters of said cartridges through the electric igniter contacts of the contact pads of the launcher base; and whereby more than one cartridge may be discharged substantially simultaneously.

9. The multiple projectile launcher system of claim 8, wherein a payload of at least one of said plural cartridges comprises a less-lethal munition.

10. The multiple projectile launcher system of claim 8, wherein a payload of at least one of said plural cartridges comprises more than one munition.

11. The multiple projectile launcher system of claim 8, wherein each of said slots in said cassette releasably engages a cartridge whereby the cartridge may be (i) held in place in the cassette and/or (ii) disengaged from the cassette.

12. The multiple projectile launcher system of claim 8, wherein each of said plural cartridges is affixed within one of said slots in said cassette.

13. The multiple projectile launcher system of claim 8, wherein each of said plural cartridges comprises:

a tubular substantially cylindrical case for containing said payload, said case having a launching end and a priming end, wherein said electric igniter is positioned at said priming end, and wherein an igniter center electrode is positioned with an interior end in contact with said electric igniter and an exterior end exposed on the outside of the priming end of the cartridge.

14. The multiple projectile launcher system of claim 13, wherein each of said plural cartridges further comprises:

an outer lip protruding from the outer circumference of the cartridge at the priming end.

15. The multiple projectile launcher system of claim 14, wherein each of said slots in said cassette comprises a tapered inner surface wherein a diameter of the slot on a loading side of the cassette is larger than a diameter of the slot on a firing side of the cassette, whereby said tapered inner surface releasably engages the outer lip of the cartridge.

16. The multiple projectile launcher system of claim 15, wherein said outer lip comprises:

an O-ring securely positioned in an indentation formed around the outer circumference of the cartridge at the priming end, wherein said O-ring forms a friction seal with the tapered inner surface of the slot when said cartridge is inserted into said slot.

17. The multiple projectile launcher system of claim 16, wherein said O-ring comprises rubber.

18. The multiple projectile launcher system of claim 13, wherein the cassette is formed by holding the tubular cases of the plural cartridges in place while a material is molded around the priming ends of the cartridges whereby said material, once molded, comprises the cassette.

19. The multiple projectile launcher system of claim 18, wherein the material comprises a polymer.

20. The multiple projectile launcher system of claim 18, wherein propellant and payload are placed in said plural cartridges after said cassette has been formed.

21. The multiple projectile launcher system of claim 8, wherein each of said plural cartridges comprises:

a case for containing said payload, said case having a launching end and a priming end, wherein said electric igniter is positioned at said priming end, and wherein an igniter center electrode is positioned with an interior end in contact with said electric igniter and an exterior end exposed on the outside of the priming end of the cartridge.

22. The multiple projectile launcher system of claim 21, wherein said cassette comprises a substantially planar body.

23. The multiple projectile launcher system of claim 22, wherein said plural cartridges are held in the cassette such that the launching ends of the cases of the plural cartridges are substantially parallel, whereby said payloads, when launched, will travel substantially similar and substantially parallel paths.

24. The multiple projectile launcher system of claim 21, wherein the movable cassette holder comprises:

at least one guide rail for releasably engaging the cassette, wherein the cassette is loaded onto said launcher base by engaging said at least one guide rail.

25. The multiple projectile launcher system of claim 24, wherein at least one lateral side of the cassette has a protruding lip.

26. The multiple projectile launcher system of claim 25, wherein said at least one guide rail comprises:

an inner track capable of engaging the protruding lip of the cassette, wherein the cassette is loaded onto said launcher base by threading the protruding lip of the cassette onto the inner track of the at least one guide rail.

27. The multiple projectile launcher system of claim 21, wherein each of the contact pads in the launcher base further comprises:

an insulator surrounding the electric igniter contact; and a ground contact separated from the electric igniter contact by said insulator;

wherein, when said plural cartridges are locked and primed, said ground contact is in contact with a remaining portion of the priming end of the cartridge in the slot corresponding to the contact pad.

28. The multiple projectile launcher system of claim 8, wherein said movable cassette holder further comprises:

a sliding mechanism for moving said movable cassette holder such that the cassette is locked into position.

29. The multiple projectile launcher system of claim 28, wherein the motive power for moving the sliding mechanism is provided by an electric motor, an air piston, and/or a user of the multiple projectile launcher system.

30. The multiple projectile launcher system of claim 28, wherein, when in the locked position, said plural cartridges are primed.

31. The multiple projectile launcher system of claim 30, wherein said plural cartridges are primed by moving the cassette such that the igniter center electrode at the priming end of each cartridge is in contact with the electric igniter contact in one of the contact pads of the launcher base.

32. The multiple projectile launcher system of claim 28, wherein each slot on a loading side of the cassette and each contact pad of the launcher base are constructed such that, when the cassette is locked, at least a top portion of each contact pad is partially inserted inside the corresponding slot on the loading side of the cassette and in physical contact with the priming end of the cartridge in the corresponding slot, thereby making a substantially environment-impermeable seal.

33. The multiple projectile launcher system of claim 8, wherein the electric igniter contact in each of the contact pads of the launcher base is spring-loaded.

34. The multiple projectile launcher system of claim 8, further comprising:

a fire control system for supplying an electric charge to the electric igniter contacts of the contact pads of the launcher base whereby the firing of said plural cartridges may be controlled.

35. The multiple projectile launcher system of claim 34, wherein the fire control system comprises: a fire control panel by which a user controls the fire control system.

36. The multiple projectile launcher system of claim 35, wherein the fire control panel may be substantially physically separated from the launcher base and provide control signals over either a wire or a wireless connection.

37. The multiple projectile launcher system of claim 36, wherein the fire control panel is hand-held, thereby allowing a user to control the firing of the multiple projectile launcher system while remaining mobile.

38. The multiple projectile launcher system of claim 8, wherein the movable cassette holder and the contact pads corresponding to the cartridges held in the cassette held in the movable cassette holder comprise a first cassette bank.

39. The multiple projectile launcher system of claim 38, wherein the first cassette bank has a first at least one of an elevation and an azimuth relative to the launcher base.

40. The multiple projectile launcher system of claim 39, said launcher base further comprising:

a second cassette bank comprising a movable cassette holder and the contact pads corresponding to the cartridges held in a cassette held in the movable cassette holder;

wherein said second cassette bank has a second at least one of an elevation and an azimuth relative to the launcher base different from the first at least one of an elevation and an azimuth relative to the launcher base.

41. The multiple projectile launcher system of claim 38, wherein the first cassette bank is movable relative to the launcher base, whereby at least one of an elevation and an azimuth of the first cassette bank relative to the launcher base may be changed.

42. The multiple projectile launcher system of claim 38, wherein the launcher base is movable relative to its surrounding environment, whereby at least one of an elevation and an azimuth of the first cassette bank relative to the surrounding environment may be changed.

43. The multiple projectile launcher system of claim 8, wherein the multiple projectile launcher is mounted to a vehicle.

44. The multiple projectile launcher system of claim 8, wherein the multiple projectile launcher is mounted to a building and/or emplacement.

45. The multiple projectile launcher system of claim 44, wherein the multiple projectile launcher is mounted to an interior of the building and/or emplacement.

46. The multiple projectile launcher system of claim 8, wherein the multiple projectile launcher is mounted on a movable turret.

47. The multiple projectile launcher system of claim 46, wherein the movable turret comprises a pan-and-tilt mount.

48. The multiple projectile launcher system of claim 8, wherein each cartridge further comprises a propellant.

49. A multiple projectile launcher comprising:

a launcher base comprising:

a movable cassette holding mechanism configured to receive a cassette of cartridges, said cassette comprising a substantially planar body having slots, wherein each slot is for holding a cartridge, and wherein each of said cartridges comprises an electric igniter and a payload; and a plurality of contact pads, wherein each contact pad comprises an electric igniter contact and corresponds to one of the slots in the cassette, and wherein the cartridges of a cassette loaded into the movable cassette holding mechanism may be primed by moving said cassette such that the electric igniter contacts of the contact pads make electrical contact with the electric igniters of the cartridges;

wherein one or more cartridges primed in the cassette may be fired by applying an electric charge to the electric igniters of said one or more cartridges through the electric igniter contacts of the contact pads corresponding to said one or more cartridges; and whereby more than one cartridge may be discharged substantially simultaneously.

50. A modular system for launching multiple projectiles comprising:

a plurality of multiple projectile launcher units, each multiple projectile launcher unit comprising:

a movable cassette holding mechanism configured to receive a cassette of cartridges, said cassette comprising a substantially planar body having slots, wherein each slot is for holding a cartridge, and wherein each of said cartridges comprises an electric igniter and a payload;

a plurality of contact pads, wherein each contact pad comprises an electric igniter contact and corresponds to one of the slots in the cassette, and wherein the cartridges of a cassette loaded into the movable cassette holding mechanism may be primed by moving said cassette such that the electric igniter contacts of the contact pads make electrical contact with the electric igniters of the cartridges; and a means for attaching to, and detaching from, other multiple projectile launcher units, whereby a larger multiple projectile launching device may be configured;

wherein one or more cartridges primed in the cassette may be fired by applying an electric charge to the electric igniters of said one or more cartridges through the electric igniter contacts of the contact pads corresponding to said one or more cartridges; and whereby more than one cartridge may be discharged substantially simultaneously.

* * * * *